US008467697B2

(12) United States Patent
Kawai et al.

(10) Patent No.: US 8,467,697 B2
(45) Date of Patent: Jun. 18, 2013

(54) CLEANING MEMBER FOR IMAGE FORMING APPARATUS, CHARGING DEVICE, UNIT FOR IMAGE FORMING APPARATUS, PROCESS CARTRIDGE, AND IMAGE FORMING APPARATUS

(75) Inventors: Takeshi Kawai, Kanagawa (JP); Masato Ono, Kanagawa (JP); Akihiro Nonaka, Kanagawa (JP); Taketoshi Hoshizaki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 344 days.

(21) Appl. No.: 12/899,891

(22) Filed: Oct. 7, 2010

(65) Prior Publication Data

US 2011/0170901 A1 Jul. 14, 2011

(30) Foreign Application Priority Data

Jan. 13, 2010 (JP) ..... 2010-005279
Jul. 21, 2010 (JP) ..... 2010-163736

(51) Int. Cl.
*G03G 15/02* (2006.01)
*G03G 21/00* (2006.01)

(52) U.S. Cl.
USPC ..... 399/100; 399/357

(58) Field of Classification Search
USPC ..... 399/100, 101, 353, 357; 15/256.5, 15/256.51, 256.52
See application file for complete search history.

(56) References Cited

U.S. PATENT DOCUMENTS

2003/0059225 A1* 3/2003 Shimizu ..... 399/100
2011/0170896 A1* 7/2011 Yamaguchi ..... 399/100

FOREIGN PATENT DOCUMENTS

| | | |
|---|---|---|
| JP | A-2-272594 | 11/1990 |
| JP | A-7-129055 | 5/1995 |
| JP | A-7-219313 | 8/1995 |
| JP | A-2001-209238 | 8/2001 |
| JP | A-2005-301000 | 10/2005 |
| JP | A-2007-199264 | 8/2007 |
| JP | A-2008-145566 | 6/2008 |

* cited by examiner

*Primary Examiner* — Sophia S Chen
(74) *Attorney, Agent, or Firm* — Oliff & Berridge, PLC

(57) ABSTRACT

The present invention provides a cleaning member for an image forming apparatus, including: a shaft body; and an elastic material that is wound on the outer peripheral surface of the shaft body in a spiral shape, the elastic material satisfying the following expressions. (A1): $1<Tb/Ta<1.75$. (A2): $0.5<Ta<4.0$. In expressions (A1) and (A2), Ta represents a thickness of a center portion in the spiral width direction of the elastic material in millimeters, and Tb represents a thickness of both end portions in the spiral width direction of the elastic material in millimeters.

15 Claims, 9 Drawing Sheets

CLEANING MEMBER FOR IMAGE FORMING APPARATUS, CHARGING DEVICE, UNIT FOR IMAGE FORMING APPARATUS, PROCESS CARTRIDGE, AND IMAGE FORMING APPARATUS

CROSS-REFERENCE TO RELATED APPLICATION

This application is based on and claims priority under 35 USC 119 from Japanese Patent Application Nos. 2010-005279 filed Jan. 13, 2010, and 2010-163736 filed Jul. 21, 2010.

BACKGROUND

1. Technical Field

The present invention relates to a cleaning member for an image forming apparatus, a charging device, a unit for an image forming apparatus, a process cartridge, and an image forming apparatus.

2. Related Art

In image forming apparatuses employing an electrophotographic system, the surface of an image carrier formed of a photoreceptor or the like is first charged by a charging device to form electric charges and an electrostatic latent image is formed by a laser beam or the like obtained by modulating an image signal. Thereafter, the electrostatic latent image is developed with a charged toner to form a toner image for visualization. The toner image is electrostatically transferred, directly or via an intermediate transfer member, to a transfer medium such as a recording sheet, and is fixed to the transfer medium, whereby an image is obtained.

A cleaning roll including an elastic material arranged in a spiral shape, which is mounted on an image forming apparatus, has been proposed.

SUMMARY

According to an aspect of the invention, a cleaning member for an image forming apparatus, including: a shaft body; and an elastic material that is wound on the outer peripheral surface of the shaft body in a spiral shape, the elastic material satisfying the following Expressions (A1) and (A2):

$$1<Tb/Ta<1.75 \quad \text{Expression (A1)}$$

$$0.5<Ta<4.0, \quad \text{Expression (A2)}$$

wherein, in Expressions (A1) and (A2), Ta represents a thickness of a center portion in a spiral width direction of the elastic material in millimeters, and Tb represents a thickness of both end portions in the spiral width direction of the elastic material in millimeters, is provided.

BRIEF DESCRIPTION OF THE DRAWINGS

Exemplary embodiments of the invention will be described in detail based on the following figures, wherein.

DETAILED DESCRIPTION

Figure 1:
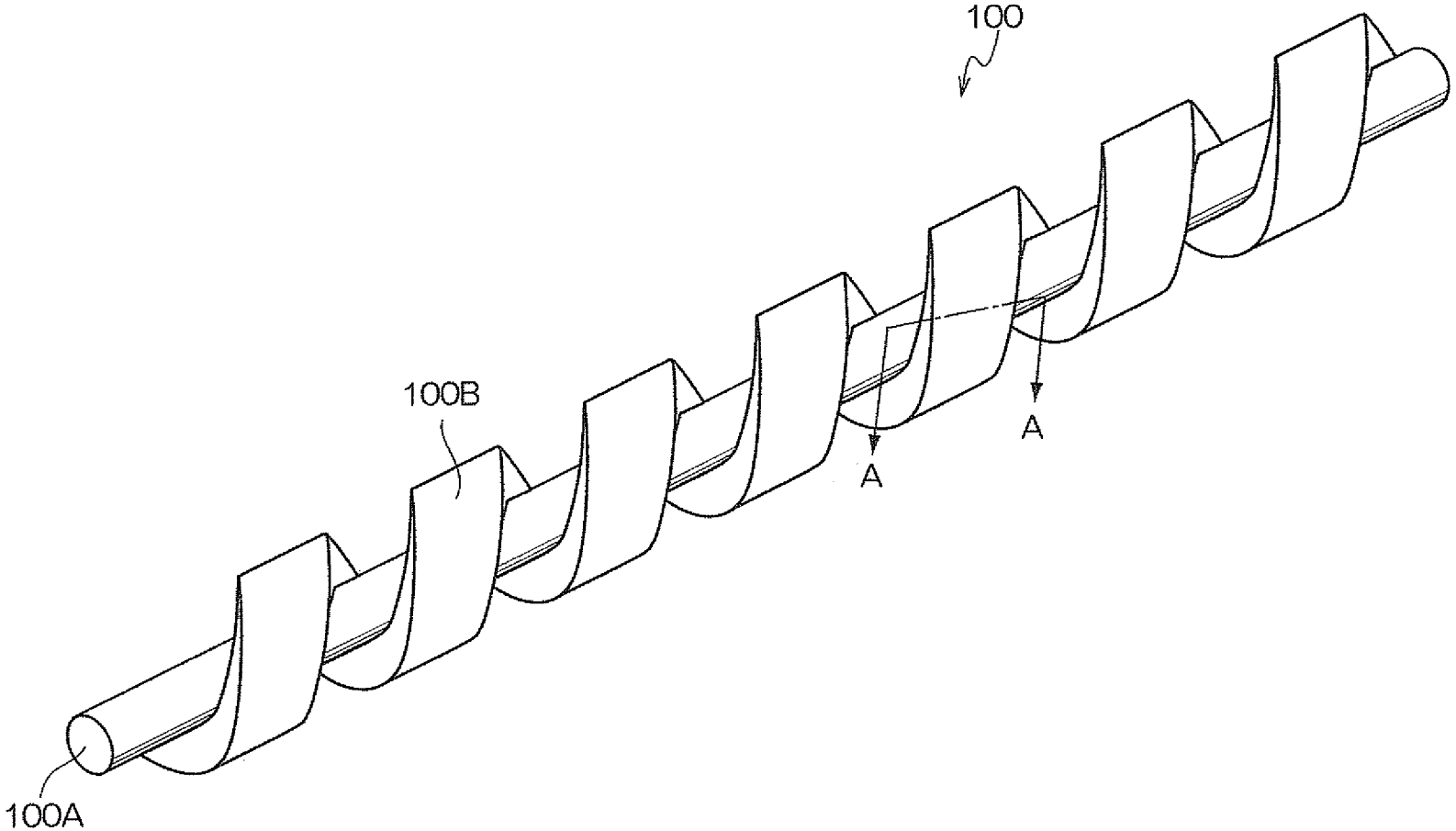
FIG. 1 is a perspective view schematically illustrating a cleaning member for an image forming apparatus according to an exemplary embodiment of the invention.

Exemplary embodiments according to the aspect of the invention include, but are not limited to the following items <1> to <14>.

<1> A cleaning member for an image forming apparatus, including: a shaft body; and an elastic material that is wound on the outer peripheral surface of the shaft body in a spiral shape, the elastic material satisfying the following Conditional Expressions (A1) and (A2):

$$1<Tb/Ta<1.75 \quad \text{Expression (A1)}$$

$$0.5<Ta<4.0, \quad \text{Expression (A2)}$$

in Expressions (A1) and (A2), Ta representing a thickness of a center portion in a spiral width direction of the elastic material in millimeters, and Tb representing a thickness of both end portions in the spiral width direction of the elastic material in millimeters.

<2> The cleaning member for an image forming apparatus according to the item <1>, wherein the elastic material satisfies the following Expressions (B1) and (B2):

$$1.02<Tb/Ta<1.5 \quad \text{Expression (B1)}$$

$$1.0<Ta<3.0, \text{ and} \quad \text{Expression (B2)}$$

in Expressions (B1) and (B2), Ta and Tb each independently represent the same definitions as those in Expressions (A1) and (A2).

<3> The cleaning member for an image forming apparatus according to the item <1> or the item <2>, wherein a spiral angle θ of the elastic material is in a range of from about 10° to about 65° and a spiral width of the elastic material is in a range of from about 3 mm to about 25 mm.

<4> The cleaning member for an image forming apparatus according to any one of the items <1> to <3>, wherein a spiral pitch of the center portion of the elastic material in an axial direction of the shaft body is less than a spiral pitch of both ends in the axial direction of the shaft body.

<5> The cleaning member for an image forming apparatus according to the item <4>, wherein the elastic material is a strip-shaped member that is wound on the outer peripheral surface of the shaft body from one end to another end in the axial direction of the shaft body, the strip-shaped elastic material including: a linear center portion; a first end portion bent or curved toward one side in a width direction from one end in a longitudinal direction of the center portion; and a second end portion bent or curved toward the opposite side in the width direction from the opposite end in the longitudinal direction of the center portion.

<6> The cleaning member for an image forming apparatus according to the item <4> or the item <5>, wherein the spiral pitch is in a range of from about 3 mm to about 25 mm.

<7> The cleaning member for an image forming apparatus according to any one of the items <4> to <6>, wherein a coverage of the elastic material is in a range of from about 20% to about 70%; the coverage of the elastic material being defined by a relationship of 100R1/(R1+R2), wherein R1 represents a spiral width of the elastic material, and R2 represents a spiral pitch of the elastic material.

<8> The cleaning member for an image forming apparatus according to any one of the items <1> to <7>, wherein the elastic material includes polyether urethane foamed by using a foam stabilizer other than silicon oil.

<9> A charging device including: a charging member that charges a member to be charged; and a cleaning member for an image forming apparatus according to any one of the items <1> to <8>, which is disposed so as to contact a surface of the charging member and clean the surface of the charging member.

<10> The charging device according to item <9>, wherein the member is a photoreceptor.

<11> A process cartridge including at least the charging device according to the item <9> and being detachably attached to an image forming apparatus.

<12> An image forming apparatus including: an image carrier; a charging unit that charges a surface of the image carrier and that includes the charging device according to the item <9>; a latent image forming unit that forms a latent image on the charged surface of the image carrier; a developing unit that develops the latent image formed on the image carrier into a toner image by use of a toner; and a transfer unit that transfers the toner image onto a transfer medium.

<13> A unit for an image forming apparatus including: a member to be cleaned; and the cleaning member for an image forming apparatus according to any one of the items <1> to <8>, which is disposed so as to contact a surface of the member to be cleaned and clean the surface of the member to be cleaned.

<14> A process cartridge including at least the unit for an image forming apparatus according to the item <13> and being detachably attached to an image forming apparatus.

<15> An image forming apparatus including the unit for an image forming apparatus according to the item <13>.

Hereinafter, exemplary embodiments of the invention will be described. In the figures, members having the same functions and operations are referenced by the same reference numerals and signs and description thereof may not be repeated.

Cleaning Member

Figure 2:
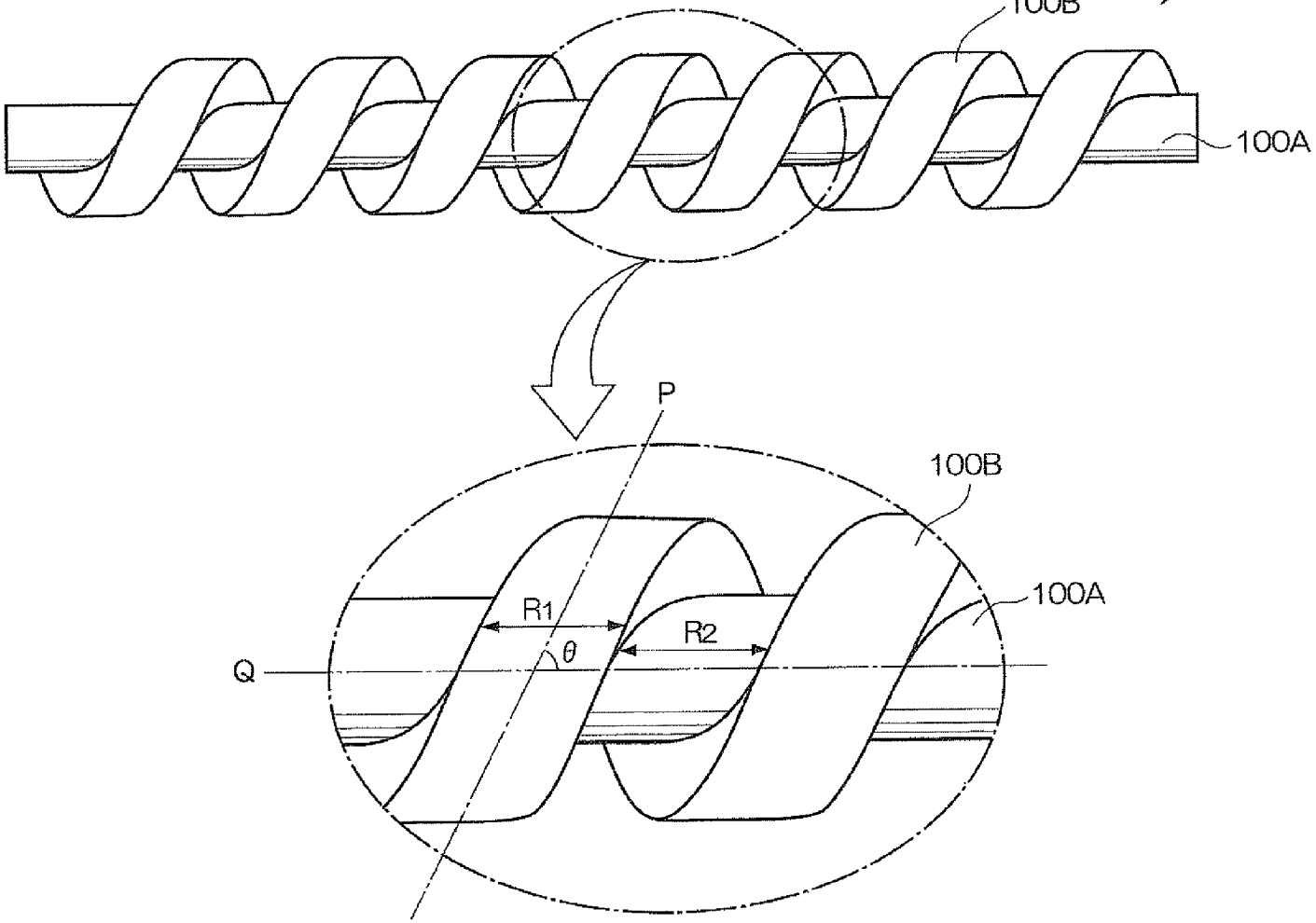
FIG. 2 is a side view schematically illustrating the cleaning member for an image forming apparatus according to the exemplary embodiment of the invention.
Figure 3:
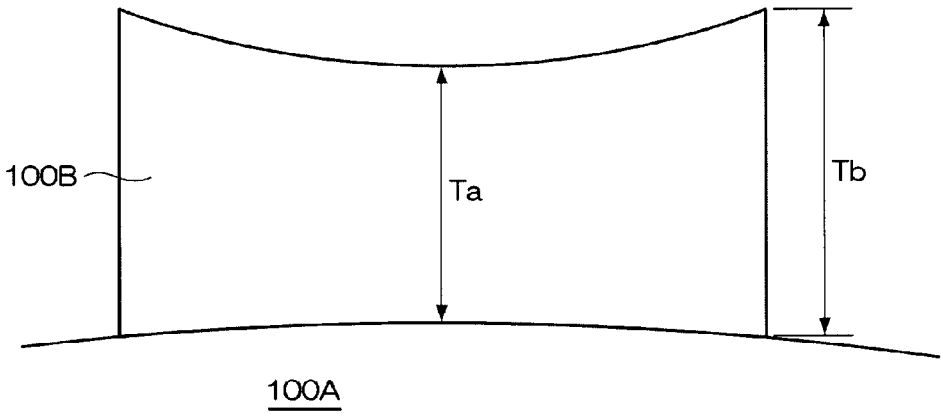
FIG. 3 is an enlarged sectional view illustrating the thickness of an elastic material in the cleaning member for an image forming apparatus according to the exemplary embodiment of the invention.
Figure 4:
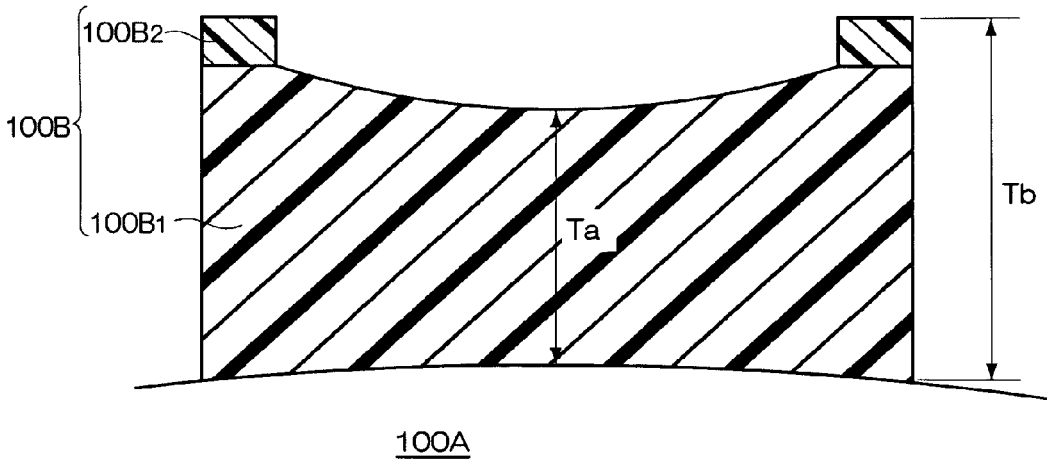
FIG. 4 is an enlarged sectional view illustrating the thickness of another elastic material in the cleaning member for an image forming apparatus according to the exemplary embodiment of the invention.

FIG. 1 is a perspective view schematically illustrating a cleaning member for an image forming apparatus according to an exemplary embodiment of the invention. FIG. 2 is a side view schematically illustrating the cleaning member for an image forming apparatus according to the exemplary embodiment of the invention. FIG. 3 is an enlarged sectional view illustrating the thickness of an elastic material in the cleaning member for an image forming apparatus according to the exemplary embodiment of the invention. FIG. 4 is an enlarged sectional view illustrating the thickness of another elastic material in the cleaning member for an image forming apparatus according to the exemplary embodiment of the invention.

FIGS. 3 and 4 are sectional views taken along the line A-A of FIG. 1, that is, sectional views taken along a direction perpendicular to a spiral direction of the elastic material (layer).

The cleaning member 100 for an image forming apparatus (hereinafter, simply referred to as "cleaning member") according to this exemplary embodiment is a roll-like member including a shaft 100A as a shaft body and an elastic layer 100B as a elastic material, as shown in FIGS. 1 to 3. The elastic layer 100B is wound in a spiral shape on the surface of the shaft 100A. Specifically, the elastic layer 100B is wound in a spiral shape with an interval from one end of the shaft 100A to the opposite end using the axis of the shaft 100A as a spiral axis.

When a thickness of the center portion in the spiral width direction of the elastic layer (material) 100B is represented by Ta (mm) and a thickness of both end portions in the spiral width direction of the elastic layer 100B is represented by Tb (mm), the elastic layer 100B satisfies Expressions (A1) and (A2) described below (see FIG. 3).

$$1<Tb/Ta<1.75 \quad \text{Expression (A1)}$$

$$0.5<Ta<4.0 \quad \text{Expression (A2)}$$

First, when the thickness Ta (hereinafter, referred to as "center thickness Ta") of the center portion in the spiral width direction of the elastic layer 100B and the thickness Tb (hereinafter, referred to as "end thickness Tb") of the end portions in the spiral width direction of the elastic layer 100B satisfy Expression (A1), the end portions in the spiral width direction of the elastic layer 100B protrude more to the outside of the cleaning member 100 than the center portion in the spiral width direction. When Expression (A1) is satisfied and Expression (A2) is satisfied, it is considered that the protruding portions of the end portions in the spiral width direction of the elastic layer 100B have a proper repulsive force.

The cleaning member 100 performs a cleaning operation with its rotation by repeatedly contacting and separating the elastic layer 100B arranged in a spiral shape with and from the surface (cleaning target surface) of a cleaning target. From the viewpoint of the surface (cleaning target surface) of a cleaning target, the corners (edges) of both end portions in the spiral width direction of the elastic layer 100B are urged in the axial direction (spiral axial direction) of the cleaning member 100, whereby the cleaning operation is carried out.

When the protruding portions of both end portions in the spiral width direction of the elastic layer 100B have a proper repulsive force and the elastic layer 100B is separated from the surface (cleaning target surface) of a cleaning target, it is considered that a frictional contact force acts on the surface (cleaning target surface) of a cleaning target due to the repulsive force of the protruding portions.

It is preferable that the elastic layer (material) 100B satisfies Expressions (B1) and (B2). It is more preferable that the elastic material satisfies Expressions (C1) and (C2).

Preferable Expressions $$1.02<Tb/Ta<1.5 \quad \text{Expression (B1)}$$

$$1.0<Ta<3.0 \quad \text{Expression (B2)}$$

More Preferable Expressions $$1.03<Tb/Ta<1.35 \quad \text{Expression (C1)}$$

$$1.5<Ta<2.5 \quad \text{Expression (C2)}$$

The center thickness Ta and the end thickness Tb of the elastic layer (material) 100B are measured as follows, for example.

The cleaning member is scanned in the longitudinal direction (axial direction) thereof with the circumferential direction of the cleaning member fixed using a laser measuring instrument (LSM 6200, trade name, which is a laser scan micrometer manufactured by MITUTOYO Corporation) at a traversing speed of 1 mm/s, whereby the profile of the thickness of the elastic material (elastic layer thickness) is measured. Thereafter, the position in the circumferential direction is shifted and the same measurement is performed (three positions with an interval of 120° in the circumferential direction). The center thickness Ta and the end thickness Tb of the elastic layer 100B are calculated on the basis of the measured profiles.

Examples of a method of rendering the elastic layer 100B to satisfy the expressions include (1) a method using NC control with an NC (Numerical Control) lathe when the elastic material is formed by cutting, (2) a method using mold size control when the elastic layer 100E is formed by molding, and (3) a method of controlling the thickness of a strip, the winding curvature of the strip, and the winding tension of the strip when a strip-like elastic material (hereinafter, which may also be simply referred to as "strip") is wound on a shaft to form the elastic layer 100B.

Another example of the method of rendering the elastic layer 100B to satisfy the expressions is a method of forming an elastic material by the above-mentioned methods and then winding another strip on the elastic material on the shaft at both end portions in the spiral width direction to form protruding portions of the elastic layer 100B out of the strip.

That is, the elastic layer 100B may be formed of a single member as shown in FIG. 3, or may be formed of two members of a base elastic layer (material) 100$B_1$ and protruding elastic layers (materials) 100$B_2$ protruding from both end portions in the spiral width direction of the base elastic layer 100$B_1$ as shown in FIG. 4.

Here, the elastic layer 100B is disposed in a spiral shape, and it is preferable that the spiral angle θ is in a range of from 10° to 65° or from about 10° to about 65° (more preferably in a range of from 20° to 50° or from about 20° to about 50°) and the spiral width R1 is in a range of from 3 mm to 25 mm or from about 3 mm to about 25 mm (more preferably in a range of from 3 mm to 10 mm or from about 3 mm to about 10 mm). The spiral pitch R2 is preferably in a range of from 3 mm to 25 mm or from about 3 mm to about 25 mm (more preferably in a range of from 15 mm to 22 mm or from about 15 mm to about 22 mm).

Particularly, when a strip is wound on a shaft to form the elastic layer 100B, the expressions can be easily satisfied, that is, the cleaning capability can be suitably improved, bby controlling the spiral angle and the spiral width to be in the above-mentioned ranges.

A coverage of the elastic layer 100B (spiral width R1 of elastic layer 100B/spiral width R1 of elastic layer 100B+spiral pitch R2 of elastic layer 100B (R1+R2)) is preferably in a range of from 20% to 70% or from about 20% to about 70% and more preferably in a range of from 25% to 55% or from about 25% to about 55%.

When the coverage is greater than the above-mentioned range, the time that the elastic layer 100B is in contact with a cleaning target increases and thus attachments (pollutions) attached to the surface of the cleaning member tend to be re-contaminated to the cleaning target. When the coverage is less than the above-mentioned range, the thickness of the elastic layer 100B is not stabilized well and thus the cleaning capability decreases.

Here, the spiral angle θ means an angle (acute angle) at which the longitudinal direction P (spiral direction) of the elastic layer 100B and the axial direction Q (shaft axial direction) of the cleaning member intersect each other.

The spiral width R1 means a length in the direction perpendicular to the longitudinal direction P (spiral direction) of the elastic layer 100B.

The spiral pitch R2 means a distance between the neighboring elastic layers 100B in the direction perpendicular to the longitudinal direction P (spiral direction) of the elastic layer 100B.

The elastic layer (material) 100E means a layer (material) formed of a material that is restored to an original form even when it is deformed with an application of an external force of 100 Pa.

The constituent elements will be described in detail.

First, the shaft will be described.

Examples of the material of the shaft 100A include metal (such as free-cutting steel or stainless steel) or resin (such as polyacetal resin (POM)). The material or the surface processing method may be preferably selected as needed.

Particularly, when the shaft 100A is formed of metal, a plating process is preferably performed. When the shaft is formed of a material such as resin not having conductivity, it may be subjected to a general process such as the plating process to become conductive, or may be used without any change.

Examples of the material of the elastic layer 100B include foamed resins such as polyurethane, polyethylene, polyamide, or polypropylene and materials obtained by blending one or two or more species of rubber materials such as silicone rubber, fluorine rubber, urethane rubber, ethylene-propylene-diene copolymer rubber (EPDM), acrylonitrilie-butadiene copolymer rubber (NBR), chloroprene rubber (CR), chlorinated polyisoprene rubber, isoprene rubber, acrylonitrile-butadiene rubber, styrene-butadiene rubber, hydrogenerated polybutadiene rubber, or butyl rubber. Auxiliary agents such as foaming agent, foam stabilizer, catalyst, curing agent, plasticizer, or vulcanization accelerator may be added to the materials as needed.

Among these, materials (so-called foams) having bubbles are preferable and foamed polyurethane resistant to a tension is more preferable from the viewpoint that the surface of a cleaning target should not damaged due to friction and cut or break should not be caused over long term.

Examples of polyurethane include reaction products of polyol (such as polyester polyol, polyether polyester, or acrylpolyol) and isocyanate (such as, 2,4-toluene diisocyanate, 2,6-toluene diisocyanate, 4,4'-diphenylmethane diisocyanate, tolidine diisocyanate, or 1,6-hexamethylene diisocyanate) and may include a chain extender (such as 1,4-butane diol or trimethylolpropane). The foaming of polyurethane is generally performed using a foaming agent such as water or azo compound (such as azodicarbonamide or azobisisobutyronitrile). The auxiliary agents such as foaming agent, foam stabilizer, or catalyst may be added to the foamed polyurethane as needed.

Among these foamed polyurethanes, ether foamed polyurethane may be suitably used. This is because the ester foamed polyurethane tends to easily deteriorate with humidity and heat. Silicone oil is mainly used as a foam stabilizer in the ether foamed polyurethane, but an image defect may be generated due to the migration of the silicone oil to a cleaning target (for example, a charging roll) or the like during storage (particularly during long-term storage under a high temperature and a high humidity). Accordingly, by using a foam stabilizer other than the silicone oil, the image defect caused by the elastic layer 100B may be suppressed.

Here, specific examples of the foam stabilizer other than the silicone oil include organic surfactants (anionic surfactants such as dodecyl benzene sulfonate or sodium lauryl sulfate) not containing Si atom. A method not using silicone foam stabilizer described in Japanese Patent Application Laid-Open No. 2005-301000 may be employed.

The elastic layer 100B may have a single-layered structure or a laminated structure. Specifically, the elastic layer 100B may have a structure including only one foam layer or may have a two-layered structure including a solid layer and a foamed layer.

A method of manufacturing the cleaning member 100 according to this exemplary embodiment will be described below.

Figure 5A:
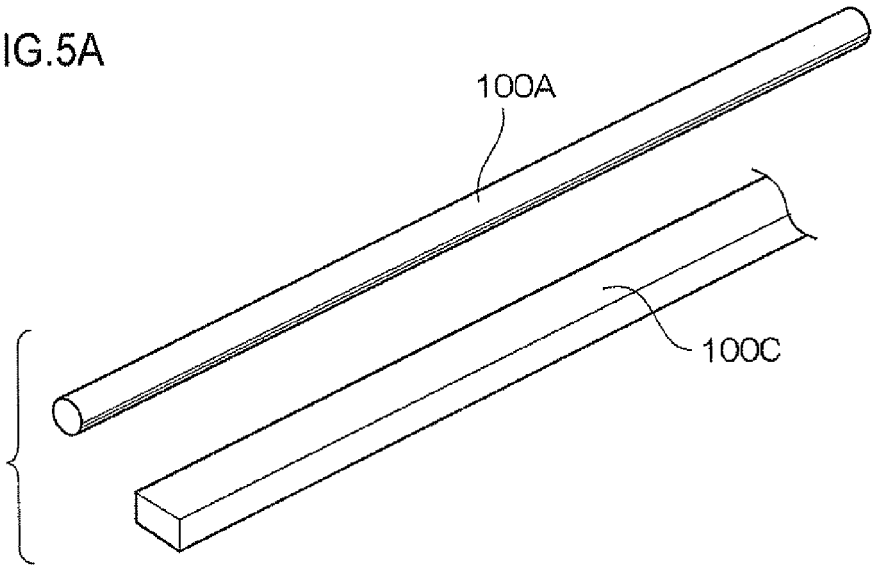
FIGS. 5A, 5B and 5C are flow diagrams illustrating a flow of a method of manufacturing the cleaning member for an image forming apparatus according to the exemplary embodiment of the invention.
Figure 5B:
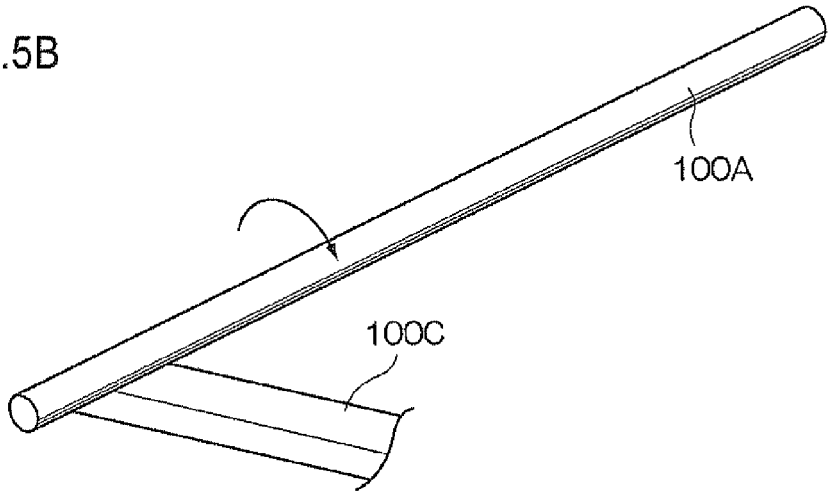
Figure 5C:
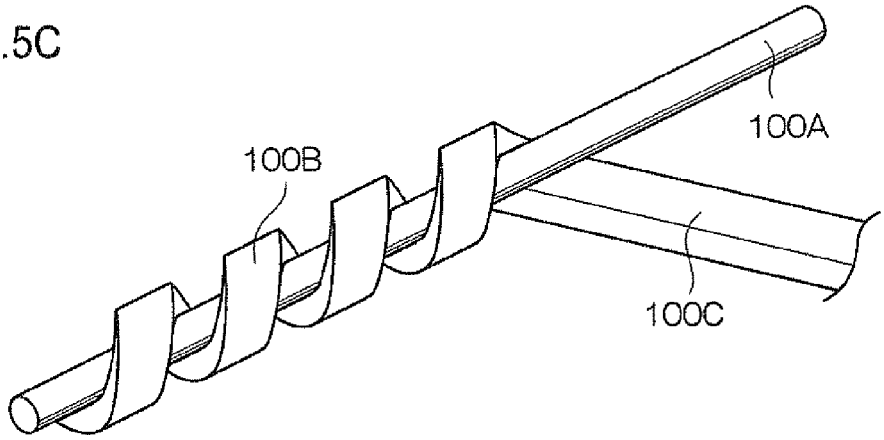

FIG. 5A, FIG. 5B and FIG. 5C are flow diagrams illustrating a flow of a method of manufacturing the cleaning member for an image forming apparatus according to the exemplary embodiment of the invention.

Examples of the method of manufacturing the cleaning member 100 according to this exemplary embodiment include the followings.

(1) A method of obtaining the cleaning member, by preparing an elastic-layer material (such as foamed polyurethane) shaped into a rectangular column, forming a hole into which the shaft 100A is inserted in the elastic-layer material by using a drill or the like, inserting the shaft 100A of which the outer peripheral surface is coated with an adhesive agent into the hole of the elastic-layer material, performing a cutting work on the elastic-layer member to form the elastic layer (material).

(2) A method of obtaining the cleaning member, by preparing an elastic-layer material (such as foamed polyurethane) formed in a cylindrical shape by using a mold, forming a hole into which the shaft 100A is inserted in the elastic-layer material by using a drill or the like, and inserting the shaft 100A of which the outer peripheral surface is coated with an adhesive agent into the hole of the elastic-layer material.

(3) A method of obtaining the cleaning member, by preparing a sheet-like elastic-layer material (such as a foamed polyurethane sheet), attaching a double-sided tape thereto, punching the resultant to obtain a strip, and winding the strip on the shaft 100A to form the elastic layer 100B.

Among these, the method of obtaining the cleaning member by winding the strip on the shaft to form the elastic layer 100B is simple and preferable.

This method will be described in more detail. First, as shown in FIG. 5(A), a sheet-like elastic-layer material (such as a foamed polyurethane sheet) having been subjected to a slicing process to have a target thickness is prepared. A double-sided tape (not shown) is attached to one surface of the sheet-like elastic-layer material and the material is punched by the use of a punch die to obtain a strip 100C (strip having a double-sided tape attached thereto) with target width and length. On the other hand, the shaft 100A is also prepared.

Then, as shown in FIG. 5(B), the strip is disposed so that the surface having the double-side tape attached thereto is directed to the upside, one end of a release paper of the double-sided tape is detached therefrom in this state, and an end portion of the shaft 100A is placed on the double-sided tape from which the release paper is detached.

As shown in FIG. 5(C), the shaft 100A is rotated at a predetermined speed while detaching the release paper from the double-sided tape, whereby the strip 100C is wound in a spiral shape on the outer peripheral surface of the shaft 100A. Finally, the cleaning member 100 having the elastic layer 100B arranged in a spiral shape on the outer peripheral surface of the shaft 100A is obtained.

Here, at the time of winding the strip 100C serving as the elastic layer 100B on the shaft 100A, the strip 100C can be positioned with respect to the axial direction of the shaft 100A so that the longitudinal direction of the strip 100C becomes a target angle (spiral angle). The outer diameter of the shaft 100A may be, for example, in a range of from Φ3 mm to Φ6 mm.

The tension applied to wind the strip 100C on the shaft 100A may be of such a magnitude that a gap is not generated between the shaft 100A and the strip 100C and the double-sided tape, and it is preferable that excessive tension is not applied. When the tension is excessive, the tensile permanent elongation increases and the elastic force of the elastic layer 100B necessary for the cleaning tends to decrease. Specifically, the tension is preferably applied so as to elongate the length of the original strip 100C by from 0% to 5%.

On the other hand, when the strip 100C is wound on the shaft 100A, the strip 100C tends to be elongated. This elongation varies in the thickness direction of the strip 100C and the outermost portion is most elongated, thereby reducing the elastic force. Accordingly, the elongation of the outermost portion after the strip 100C is wound on the shaft 100A is preferably 5% of the outermost portion of the original strip 100C.

This elongation is controlled by the radius of curvature with which the strip 100C is wound on the shaft 100A and the thickness of the strip 100C. The radius of curvature with which the strip 100C is wound on the shaft 100A is controlled by the outer diameter of the shaft 100A and the winding angle of the strip 100C.

The radius of curvature with which the strip 100C is wound on the shaft 100A is preferably in a range of from ((outer diameter of shaft/2)+0.2 mm) to ((outer diameter of shaft/2)+8.5 mm), and more preferably in a range of from ((outer diameter of shaft/2)+0.5 mm) to ((outer diameter of shaft/2)+7.0 mm).

The thickness of the strip 100C is preferably in a range of from 1.5 mm to 4 mm and more preferably in a range of from 1.5 mm to 3.0 mm. The width of the strip 100C may be adjusted so that the coverage of the elastic layer 100B is in the above-mentioned range. The length of the strip 100C is determined by the axial length of the area wound on the shaft 100A, the winding angle, and the winding tension.

Figure 6:
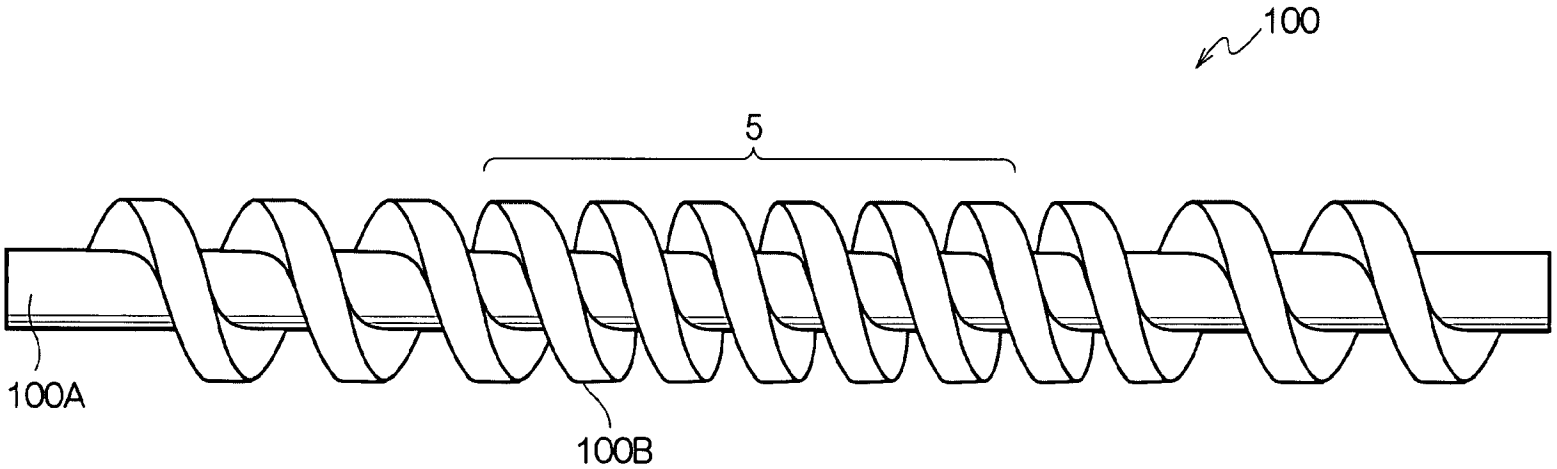
FIG. 6 is a perspective view schematically illustrating a cleaning member for an image forming apparatus according to another exemplary embodiment of the invention.

The cleaning member 100 according to this exemplary embodiment is not limited to the above-mentioned configuration. For example, as shown in FIG. 6, it is preferable that the spiral pitch R2 of the center portion of the elastic layer 100B in the axial direction of the shaft 100A is smaller than the spiral pitch R2 of both ends in the axial direction of the shaft 100A (hereinafter, this type is called a type shown in FIG. 6).

According to this configuration, the elastic layer 100B is denser in the center portion of the axial direction of the shaft 100A than in both end portions in the axial direction and is coarser in both end portions in the axial direction of the shaft 100A than in the center portion in the axial direction.

Accordingly, when the cleaning member 100 is brought into contact with a cleaning target, the contact pressure against the cleaning target in the axial center portion of the cleaning member 100 increases by the portion of the elastic layer 100B which is denser than in the axial end portions.

As a result, for example, when the cleaning target is disposed to contact another member of the image forming apparatus with a pressure applied thereto, the unevenness in contact pressure in the axial direction between the cleaning target and the another member is suppressed.

When the cleaning target (in particular, a charging roll or a transfer roll) is disposed to contact another member of the image forming apparatus with a pressure applied thereto, the contact pressure in the center portion in the axial direction tends to decrease and thus it is conceivable that, in order to suppress this problem, the outer diameter of the axial center portion can be set to be greater than that of the axial end portions. However, when the outer diameter of the axial center portion is set to be excessively large, the contact pressure of the axial end portions tends to excessively decrease.

Accordingly, by setting the contact pressure of the axial center portion of the cleaning member 100 with respect to the cleaning target to be greater than that of the axial end portions, the contact pressure of the axial center portion 5 of the cleaning target with respect to another member is greater than that of the axial end portions due to the contact pressure, and unevenness in contact pressure in the axial direction between the cleaning target and the other member can be suppressed.

Specifically, for example, when the cleaning target is the charging member (charging roll), the contact pressure between the charging member and the image carrier can be easily distributed and maintained evenly in the axial direction, thereby suppressing the charging unevenness in the axial direction. For example, when the cleaning target is the transfer member (transfer roll), the contact pressure between the charging member and the image carrier or the intermediate transfer member can be easily distributed and maintained evenly in the axial direction, and transfer unevenness in the axial direction can be suppressed.

In the cleaning member 100 of the type shown in FIG. 6, the difference in spiral pitch R2 between the axial center portion of the cleaning member 100 and the axial end portions is preferably in a range of from 10% to 100% with respect to the spiral pitch R2 of the axial end portions and more preferably in a range of from 20% to 70%. When this difference is in the above-mentioned range, it is possible to enhance the contact pressure of the axial center portion with respect to the cleaning target without excessively reducing the contact pressure of the axial end portions of the cleaning member 100 with respect to the cleaning target.

The axial center portion of the cleaning member 100 means a central portion having a length at least from 40% to 60% of the length of the cleaning member 100 in the axial direction.

Figure 7:
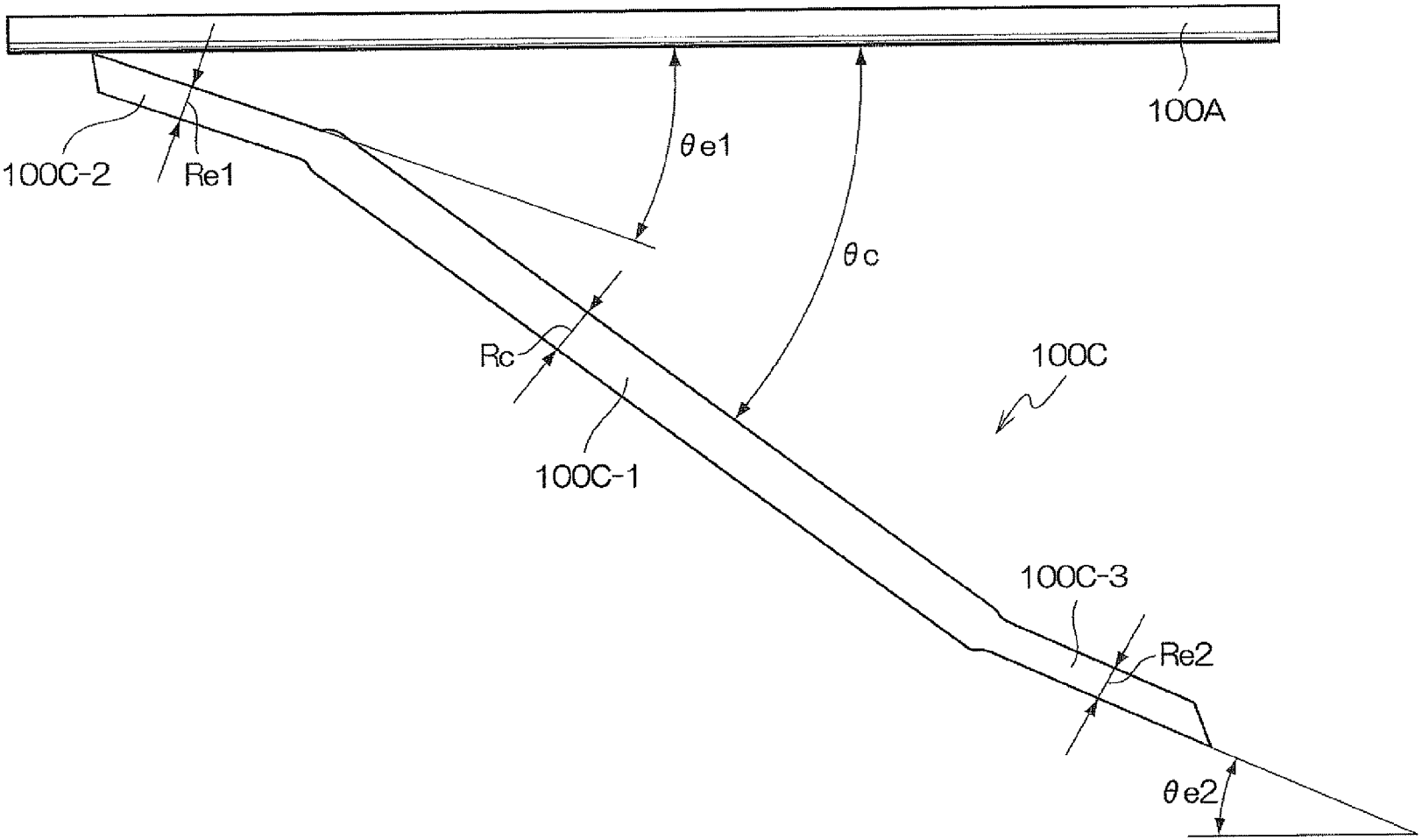
FIG. 7 is a schematic plane view illustrating a flow of a method of manufacturing the cleaning member for an image forming apparatus according to the another exemplary embodiment of the invention.
Figure 8:
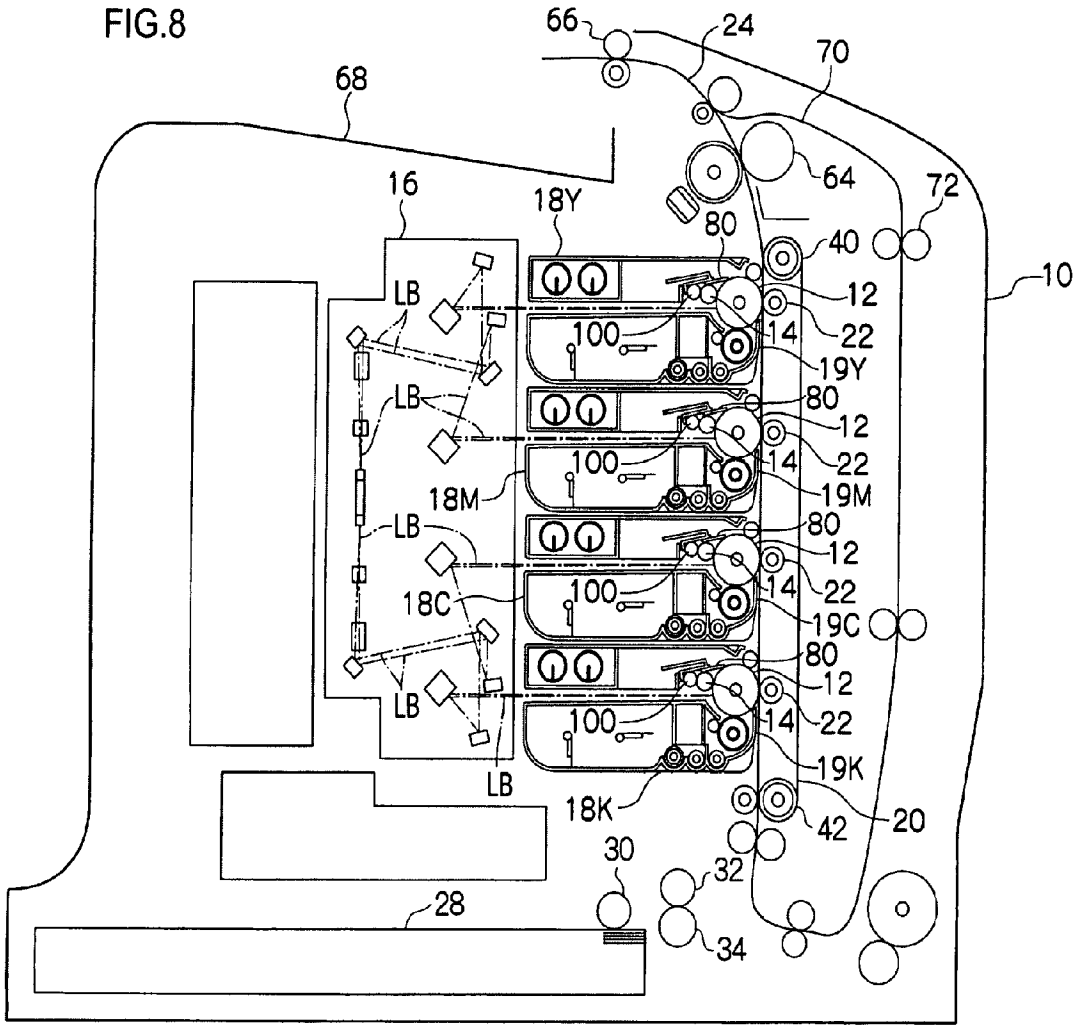
FIG. 8 is a schematic configurational view showing an electrophotographic image forming apparatus according to an exemplary embodiment.

When it is intended to prepare the cleaning member 100 of the type shown in FIG. 6 easily and at a low cost, for example, as shown in FIG. 7, a method using a strip 100C including a linear center portion 100C-1, a first end portion 100C-2 bent or curved to one side in the width direction from one end in the longitudinal direction of the center portion 100C-1, and a second end portion 100C-3 bent or curved to the opposite side in the width direction of the opposite end in the longitudinal direction of the center portion 100C-1, as the strip 100C, can be suitably used at the time of winding the strip 100C (elastic material formed in a strip shape) on the shaft 100A to form the elastic layer 100B.

Regarding the strip 100C, in the state in which the strip 100C and the shaft 100A are arranged at the time of winding the strip 100C on the shaft 100A, the first end portion 100C-2 of the strip 100C is an end portion bent or curved in the width direction from one end in the longitudinal direction of the center portion 100C-1, the first end portion 100C-2 bearing away from the shaft 100A and being an end portion from which the winding is started. The second end portion 100C-3 of the strip 100C is an end portion bent or curved in the width direction from the opposite end in the longitudinal direction of the center portion 100C-1, the second end portion 100C-3 becoming closer to the shaft 100A and being an end portion at which the winding is ended.

That is, in the strip 100C, the center portion 100C-1 is wound at a larger angle with respect to the axial direction of the shaft 100A than those of the first end portion 100C-2 from which the winding is started and the second end portion 100C-3 at which the winding is ended (wherein the first end portion 100C-2 and the second end portion 100C-3 are equal to each other in the winding angle).

In other words, when the angle (acute angle) formed by the longitudinal direction of the center portion 100C-1 of the strip 100C and the axial direction of the shaft 100A is represented by θc, the angle (acute angle) formed by the longitudinal direction of the first end portion 100C-2 of the strip 100C and the axial direction of the shaft 100A is represented by θe1, and the angle (acute angle) formed by the longitudinal direction of the second end portion 100C-3 of the strip 100C and the axial direction of the shaft 100A is represented by θe2, the strip 100C may be preferably configured to satisfy an expression of θc>θe1, an expression of θc>θe2, and an expression of θe1=θe2.

Accordingly, when the strip 100C having this configuration is wound on the shaft 100A, the spiral angle θ of the elastic layer 100B in the center portion in the axial direction of the shaft 100A is greater than the spiral angle θ of the elastic layer 100B in both end portions of the shaft 100A and the elastic layer 100B is formed in this state. As a result, in the obtained cleaning member 100, the spiral pitch R2 of the elastic layer 100B in the center portion in the axial direction of the shaft 100A is smaller than the spiral pitch R2 in both end portions in the axial direction of the shaft 100A.

As shown in FIG. 7, the strip 100C may be configured so that the width of the center portion 100C-1 is greater than the widths of the first end portion 100C-2 and the second end portion 100C-3. Specifically, the strip 100C may be configured to satisfy an expression of Rc>Re1, an expression of Rc>Re2, and an expression of Re1=Re2, where Re represents the width of the center portion 100C-1, Re1 represents the width of the first end portion 100C-2, and Re2 represents the width of the second end portion 100C-3.

Accordingly, when the strip 100C having this configuration is wound on the shaft 100A, the spiral width R1 of the elastic layer 100B in the center portion in the axial direction of the shaft 100A is greater than the spiral width R1 of the elastic layer 100B in both end portions of the shaft 100A and the elastic layer 100B is formed in this state. As a result, in the obtained cleaning member 100, the spiral pitch R2 of the elastic layer 100B in the center portion in the axial direction of the shaft 100A is smaller than the spiral pitch R2 in both end portions in the axial direction of the shaft 100A.

Image Forming Apparatus and Others

The configuration of an image forming apparatus according to this exemplary embodiment will be described below with reference to the accompanying figures.

Figure 10:
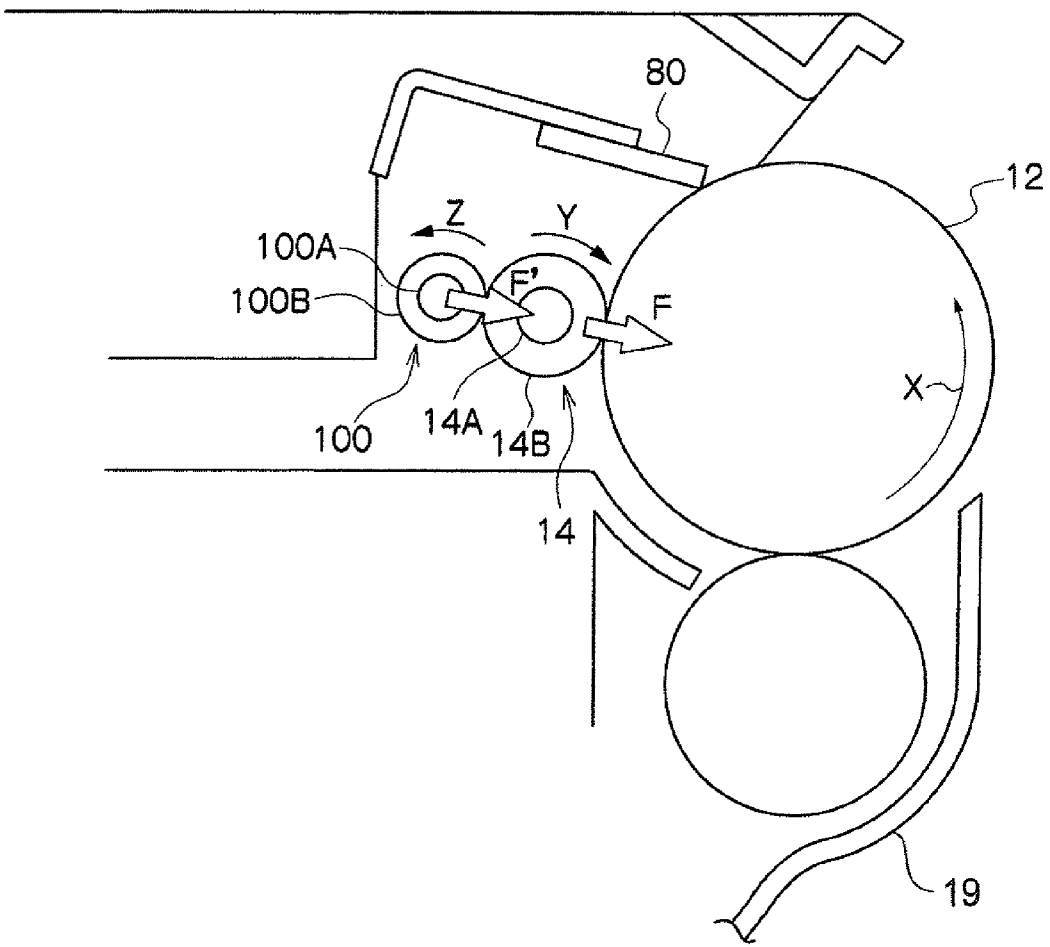
FIG. 10 is an enlarged view schematically illustrating the periphery of a charging member (charging device) in FIGS. 8 and 9.

FIG. 10 is a schematic configurational view illustrating the image forming apparatus according to this exemplary embodiment.

Figure 9:
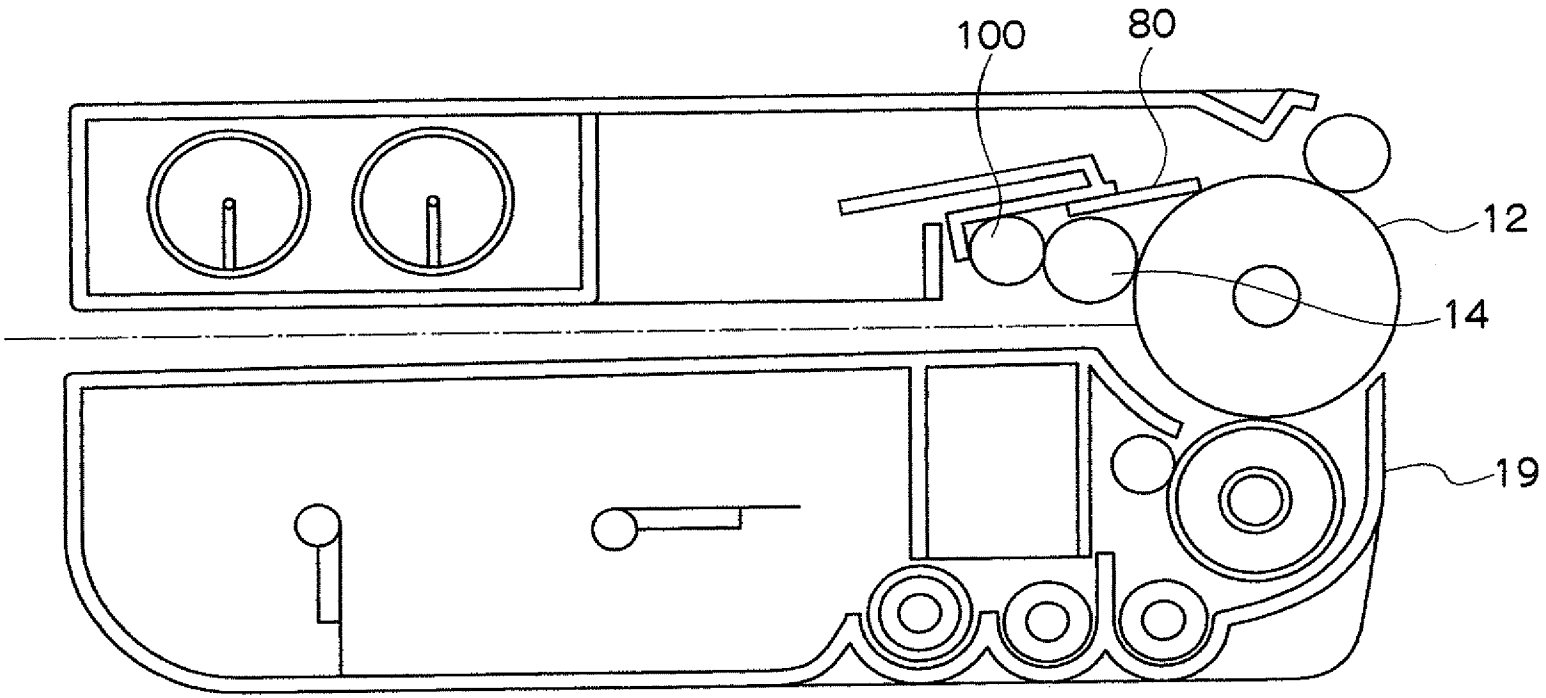
FIG. 9 is a schematic configurational view showing a process cartridge according to an exemplary embodiment.

The image forming apparatus 10 according to this exemplary embodiment is a tandem type color image forming apparatus, for example, as shown in FIG. 10. In the image forming apparatus 10 according to this exemplary embodiment, a photoreceptor (image carrier) 12, a charging member 14, a developing device, and the like are provided as a process cartridge (see FIG. 9) for each color of yellow (18Y), magenta (18M), cyan (18C), and black (18K). The process cartridges can be mounted (attached) on and demounted (detached) from the image forming apparatus 10.

For example, a conductive cylinder with a diameter of 25 mm having a surface coated with a photosensitive layer formed of an organic photoconductive material or the like is used as the photoreceptor 12, and is rotationally driven at a process speed of 150 mm/sec by a motor not shown.

The surface of the photoreceptor 12 is charged by the charging member 14 disposed on the surface of the photoreceptor 12 and is exposed to an image exposure using a laser beam LB emitted from an exposure device 16 at the downstream side of the charging member 14 in the rotation direction of the photoreceptor 12, whereby an electrostatic latent image based on image information is formed thereon.

The electrostatic latent images formed on the photoreceptors 12 are developed by the developing devices 19Y for yellow (Y) color, 19M for magenta (M) color, 19C for cyan (C) color, and 19K for black (K) color respectively, to form toner images of the corresponding colors.

For example, when a color image is formed, the charging, exposing, and developing processes are performed on the surfaces of the photoreceptors 12 of yellow (Y), magenta (M), cyan (C), and black (K) colors, respectively, and thus toner images corresponding to the colors of yellow (Y), magenta (M), cyan (C), and black (K) colors are formed on the surfaces of the photoreceptors 12 by colors, respectively.

The color toner images of yellow (Y), magenta (M), cyan (C), and black (K) sequentially formed on the photoreceptor 12 are transferred to a recording sheet 24, which is carried to the outer circumference of the photoreceptor 12 by the sheet carrying belt 20, at a position where the photoreceptor 12 and the transfer device 22 are approximate with each other via the sheet carrying belt 20 which is supplied with a tension from the support rolls 40 and 42 and which is supported from its inner peripheral surface.

The recording sheet 24 onto which the toner images are transferred from the photoreceptors 12 is carried to a fixing device 64 and heated and pressurized by the fixing device 64, whereby the toner images are fixed onto the recording sheet 24. Thereafter, in one-sided printing, the recording sheet 24 onto which the toner image are fixed is discharged to a discharge unit 68 disposed in the upper portion of the image forming apparatus 10 by a discharge roller 66.

The recording sheet 24 is taken out of a sheet container 28 by the pickup roller 30 and is carried to the sheet carrying belt 20 by the feed rolls 32 and 34.

On the other hand, in double-sided printing, the recording sheet 24 in which the toner images are fixed onto the first surface (front surface) by the fixing device 64 is not discharged to the discharge unit 68 by the discharge roller 66. Instead, in the state where the trailing edge portion of the recording sheet 24 is nipped by the discharge roller 66, the discharge roller 66 is inverted and the carrying path of the recording sheet 24 is switched to a double-sided sheet carrying path 70, the recording sheet is carried to the sheet carrying belt 20 by a carrying roller 72 disposed in the double-sided sheet carrying path 70 in the state where the front and back of the recording sheet 24 are inverted, and the toner images are transferred onto the second surface (back surface) of the recording sheet 24 from the photoreceptors 12. Then, the toner images on the second surface (back surface) of the recording sheet 24 are fixed by the fixing device 64 and the recording sheet 24 (transfer medium) is discharged to the discharge unit 68.

From the surface of the photoreceptor 12 after the process of transferring the toner image is ended, the remaining toner or paper powders are removed by a cleaning blade 80 disposed, on the surface of the photoreceptor 12, downstream from the approximate position with the transfer device 22 in the rotation direction of the photoreceptors 12 every turn of the photoreceptor 12, so as to cope with the next image forming step.

Here, as shown in FIG. 10, the charging member 14 is, for example, a roller in which an elastic layer 14B is formed around a conductive shaft 14A, and the shaft 14A is rotatably supported. A cleaning member 100 for the charging member 14 comes in contact with the charging member 14 at the opposite side to the photoreceptor 12 to constitute a charging device (unit). The cleaning member 100 according to this exemplary embodiment is used as this cleaning member 100.

Here, the method of using the cleaning member rotating to follow the rotation of the charging member 14 by normally bringing the cleaning member 100 into contact with the charging member 14 is stated, but the cleaning member 100 may be driven by the normal contact or may be driven by contact with the charging member 14 only at the time of cleaning the charging member 14. The cleaning member 100 may be brought into contact with the charging member 14 only at the time of cleaning the charging member and the circumferential speed difference from the charging member 14 may be caused by separate driving. However, the method of normally bringing the cleaning member 100 into contact with the charging member 14 to cause the circumferential speed difference is not preferable because the pollution on the charging member 14 can be easily collected and re-attached to the charging roll by the cleaning member 100.

The charging member 14 is pressed down against the photoreceptor 12 with a load F to both ends of the shaft 14A and is elastically deformed along the peripheral surface of elastic layer 14B to form a nip portion. The cleaning member 100 is pressed down against the charging member 14 with a load F' to both ends of the shaft 100A and the elastic layer 100B is elastically deformed along the peripheral surface of the charging member 14 to form a nip portion. Accordingly, the warp of the charging member 14 is suppressed to form a nip portion between the charging member 14 and the photoreceptor 12.

The photoreceptor 12 is rotationally driven in the direction of arrow X by a motor not shown and the charging member 14 rotates to follow the rotation of the photoreceptor 12 in the direction of arrow Y. The cleaning member 100 rotates to follow the rotation of the charging member 14 in the direction of arrow Z.

Configuration of Charging Member

The charging member will be described below, but this exemplary embodiment is not limited to the below configuration. Reference numerals and signs will not be described.

The configuration of the charging member is not particularly limited, and an example thereof includes a configuration including a shaft and an elastic layer (material) or a resin layer instead of the elastic layer. The elastic layer may have a single-layered structure or a multi-layered structure including plural different layers having various functions. The elastic layer may be subjected to surface treatment.

Examples of the material of the shaft include free-cutting steel and stainless steel, and the material and the surface processing method may be preferably selected depending on the application for such as a slide member. It is preferable to plate the shaft. A material not having conductivity may be processed by a general process such as a plating process to have conductivity, or may be used without being subjected to any process.

The elastic layer (material) may be formed of a conductive elastic layer (material). For example, the conductive elastic layer includes an elastic material such as rubber having elasticity and a conductive agent such as carbon black or an ion conductive agent for adjusting the resistance of the conductive elastic layer, and a material, which can be typically added to rubber, such as a softening agent, a plasticizer, a curing agent, a vulcanizing agent, a vulcanization accelerator, an anti-aging agent, or a filler of silica or calcium carbonate as needed may be added to the conductive elastic layer. The peripheral surface of the conductive shaft is coated with a mixture containing the material which can be typically added to rubber. An agent in which a conductive material, using one of electrons or ions as charge carriers, such as carbon black or an ion conductive agent blended into a matrix material is dispersed is used as the conductive agent for adjusting the resistance. The elastic material may be foam.

The elastic material forming the conductive elastic layer is formed, for example, by dispersing a conductive agent in a rubber material. Examples of the rubber material include silicone rubber, ethylene propylene rubber, epichlorohydrin-ethyleneoxide copolymer rubber, epichlorohydrin-ethyleneoxide-allylglycidylether copolymer rubber, acrylonitrile-butadiene copolymer rubber, and blended rubber thereof. The rubber material may be foamed or non-foamed.

As the conductive agent, an electronic conductive agent and an ionic conductive agent are used. Examples of the electronic conductive agent include fine powders of, for example, carbon black such as Ketjen black or acetylene black; pyrolyzed carbon, graphite; various kinds of conductive metals or alloys such as aluminum, copper, nickel, or stainless steel; various kinds of conductive metal oxides such as tin oxide, indium oxide, titanium oxide, tin oxide-antimony oxide solid solution, or tin oxide-indium oxide solid solution; and insulating materials having a conductive surface. Examples of the ionic conductive agent include perchlorate or chlorate of an onium such as tetraethyl ammonium or lauryl trimethyl ammonium; perchlorate or chlorate of alkali metal or alkaline-earth metal such as lithium or magnesium and the like.

The conductive agents may be used alone or in combination of at least two kinds thereof.

An addition amount of the conductive agent is not particularly restricted. However, in the case of the electronic conductive agent, an addition amount of the conductive agent is preferably in a range of from 1 part by weight to 60 parts by weight with respect to 100 parts by weight of the rubber material. On the other hand, in the case of the ionic conductive agent, an addition amount of the ionic conductive agent is preferably in a range of from 0.1 parts by weight to 5.0 parts by weight with respect to 100 parts by weight of the rubber material.

A surface layer may be formed on the surface of the charging member. Any one of resin and rubber may be used as the material of the surface layer, and the material is not particularly limited. Examples of the material include polyvinylidene fluoride, tetrafluoroethylene copolymer, polyester, polyimide, and copolymer nylon.

The copolymer nylon contains at least one species of 610 nylon, 11 nylon, and 12 nylon as a polymerization unit and 6 nylon, 66 nylon, or the like as another polymerization unit contained in the copolymer.

The total content of the polymerization unit including 610 nylon, 11 nylon, and 12 nylon contained in the copolymer is preferably 10% or more by weight.

The polymeric materials may be used alone or in combination of two or more species. The number-average molecular weight of the polymeric material is preferably in a range of from 1,000 to 100,000 and more preferably in a range of from 10,000 to 50,000.

The conductive material may be contained in the surface layer to adjust the resistance value, The particle diameter of the conductive material is preferably 3 μm or less.

As the conductive agent for adjusting the resistance value of the conductive elastic layer carbon black or conductive metal oxide particles blended into a matrix material, or a conductive material which utilizes one of electrons or ions as charge carriers, such as ion conductive agents, dispersed in a matrix material may be used.

Specific examples of the carbon black include "SPECIAL BLACK 350", "SPECIAL BLACK 100", "SPECIAL BLACK 250", "SPECIAL BLACK 5", "SPECIAL BLACK 4", "SPECIAL BLACK 4 A", "SPECIAL BLACK 550", "SPECIAL BLACK 6", "COLOR BLACK FW200", "COLOR BLACK FW2", and "COLOR BLACK FW2V" (trade name, all manufactured by Degussa Inc.), and "MONARCH 1000", "MONARCH 1300", "MONARCH 1400", "MOGUL-L" and "REGAL 400 R" (trade name, all manufactured by Cabot Corporation". A pH of the carbon black is preferably 4.0 or less.

The conductive metal oxide particles which are the conductive particles for adjusting the resistance value are conductive particles of tin oxide, tin oxide doped with antimony, zinc oxide, anatase-type titanium oxide, indium tin oxide (ITO), and the like. The conductive agent is not particularly limited, as long as it is a conductive agent using electrons as charge carriers. The particles may be used alone or in combination of two or more species. The particle diameter is not limited, but tin oxide, tin oxide doped with antimony, and anatase-type titanium oxide are preferable and tin oxide and tin oxide doped with antimony are more preferable.

Fluorocarbon-based or silicone-based resins can be suitably used for the surface layer. Particularly, the surface layer is formed of fluorine-modified acrylate polymer. Particles may be added to the surface layer. Insulating particles of alumina or silica may be added and concave portions may be formed on the surface of the charging member to reduce a burden at the time of frictional contact with the photoreceptor, thereby improving the abrasion resistance of both the charging member and the photoreceptor.

An outer diameter of the charging member described above is preferably in a range of from 8 mm to 16 mm. A vernier caliper or a laser outer diameter measuring device commercially available is used to measure the outer diameter.

Micro hardness of the charging member described above is preferably in a range of from 45° to 60°. To lower the hardness, it is thought that a method of increasing an amount of added plasticizer is used or a low-hardness material such as silicone rubber is used.

A value measured by MD-1 HARDNESS METER (trade name, manufactured by KOBUNSHI KEIKI CO., LTD.) is used as the micro hardness of the charging member.

In the image forming apparatus according to this exemplary embodiment, the process cartridge including a photoreceptor (image carrier), a charging device (a unit of the charging member and the cleaning member), a developing device, and a cleaning blade (cleaning device) has been described, but the invention is not limited to this configuration. A process cartridge including a charging device (a unit of the charging member and the cleaning member) and further including one selected from the photoreceptor (image carrier), the exposure device, the transfer device, the developing device, and the cleaning blade (cleaning device) as needed may be used. The devices or members may not be made in a cartridge, but may be directly arranged in the image forming apparatus.

In the image forming apparatus according to this exemplary embodiment, the charging device is constructed by the unit of the charging member and the cleaning member, that is, the charging member is employed as a cleaning target, but the invention is not limited to this configuration. The photoreceptor (image carrier), the transfer device (transfer member: transfer roller), and the intermediate transfer member (intermediate transfer belt) may be used as the cleaning target. The units of the cleaning targets and the cleaning members disposed to contact the cleaning target may be directly arranged in the image forming apparatus, or may be made in cartridges like the process cartridges and may be arranged in the image forming apparatus.

The image forming apparatus according to the exemplary embodiment may be, without restricting to the foregoing configuration, a known image forming apparatus such as an image forming apparatus according to an intermediate transfer method or the like.

EXAMPLES

Hereinafter, the invention will be specifically described with reference to examples, but the invention is not limited to the examples.

Example 1

Example 1-1

Preparation of Cleaning Roll

A double-sided tape with a thickness of 0.2 mm is attached to a sheet of foamed urethane (EPM-70, trade name, manufactured by INOAC Corporation) with a thickness of 2 mm and the resultant is cut into a strip with a width of 6 mm and a length of 757 mm. This strip is wound on a stepped metal shaft (as which a shaft with an outer diameter of Φ6 mm, a total length of 337 mm, an outer diameter of a bearing portion of Φ4 mm, and a length of 6 mm is used and in which the effective length of the foamed urethane is 320 mm) at a winding angle of 63° while a tension is being applied to increase the sheet total length by about 0% to 5%, to form an elastic layer arranged in a spiral shape, whereby a cleaning roll is prepared.

(Preparation of Charging Roll)

Formation of Elastic Layer

The below-described mixture is kneaded with an open roll and is applied to the surface of a conductive support with a diameter of 6 mm formed of SUS416 into a cylindrical shape with a thickness of 3 mm, the resultant is put into a cylindrical mold with an inner diameter of 18.0 mm, is vulcanized at 170° C. for 30 minutes, is taken out of the mold, and is then polished, whereby a cylindrical conductive elastic layer A is obtained.

| | |
|---|---|
| Rubber material: (epichlorohydrin-ethylene oxide-arylglycidylether copolymer rubber, GECHRON 3106; trade name, manufactured by ZEON Corporation | 100 parts by weight |
| Conductive agent (carbon black ASAHI THERMAL; trade name, manufactured by ASAHI CARBON Co., Ltd.): | 25 parts by weight |

-continued

| | |
|---|---|
| Conductive agent (KETJEN BLACK EC; trade name, manufactured by LION Corporation): | 8 parts by weight |
| Ionic conductive agent (lithium perchlorate): | 1 part by weight |
| Vulcanizing agent (sulfur) 200 MESH, manufactured by TSURUMI CHEMICAL INDUSTRY Co., Ltd.: | 1 part by weight |
| Vulcanization accelerator (NOCCELER DM; trade name, manufactured by OUCHI SHINKO CHEMICAL INDUSTRIAL Co., Ltd.): | 2.0 parts by weight |
| Vulcanization accelerator (NOCCELER TT; trade name, manufactured by OUCHI SHINKO CHEMICAL INDUSTRIAL Co., Ltd.): | 0.5 parts by weight |

Formation of Surface Layer

A dispersion solution A obtained by dispersing the below-described mixture with a bead mill is diluted with methanol, the resultant is dipcoated to the surface of the conductive elastic layer A and is heated and dried at 140° C. for 15 minutes to form a surface layer with a thickness of 4 μm, whereby a conductive roll is obtained. This conductive roll is used as the charging roll.

| | |
|---|---|
| Polymer: (AMILAN CM8000; trade name, manufactured by TORAY CO, co-polymerized nylon). | 100 parts by weight |
| Conductive Agent: (SN-100P; trade name, manufactured by ISHIHARA SANGYO Co., Ltd., antimony-doped tin oxide). | 30 parts by weight |
| Solvent (methanol): | 500 parts by weight |
| Solvent (butanol): | 240 parts by weight |

Example 1-2

Preparation of Cleaning Roll

A double-sided tape with a thickness of 0.2 mm is attached to a sheet of foamed urethane (EPM-70; trade name, manufactured by INOAC Corporation) with a thickness of 2 mm and the resultant is cut into a strip with a width of 6 min and a length of 705 mm. This strip is wound on a stepped metal shaft (as which a shaft with an outer diameter of Φ6 mm, a total length of 337 mm, an outer diameter of a bearing portion of Φ4 mm, and a length of 6 mm is used. The effective length of the foamed urethane is 320 mm) at a winding angle of 61° while a tension is being applied to increase the sheet total length by about 0% to 5%, to form an elastic layer arranged in a spiral shape, whereby a cleaning roll is prepared.

(Preparation of Charging Roll)

The same product as used in Example 1-1 is used.

Example 1-3

Preparation of Cleaning Roll

A double-sided tape with a thickness of 0.2 mm is attached to a sheet of foamed urethane (EPM-70; trade name, manufactured by INOAC Corporation) with a thickness of 2 mm and the resultant is cut into a strip with a width of 10 mm and a length of 360 mm. This strip is wound on a stepped metal shaft (as which a shaft with an outer diameter of Φ6 mm, a total length of 604 mm, an outer diameter of a bearing portion of Φ4 mm, and a length of 6 min is used, and in which the effective length of the foamed urethane is 320 mm) at a winding angle of 58° while a tension is being applied to increase the sheet total length by about 0 to 5%, to form an elastic layer arranged in a spiral shape, whereby a cleaning roll is prepared.

(Preparation of Charging Roll)

The same product as used in Example 1-1 is used.

Example 1-4

Preparation of Cleaning Roll

A double-sided tape with a thickness of 0.2 mm is attached to a sheet of foamed urethane (EPM-70; trade name, manufactured by INOAC Corporation) with a thickness of 2 mm and the resultant is cut into a strip with a width of 6 mm and a length of 418 mm. This strip is wound on a stepped metal shaft (as which a shaft with an outer diameter of Φ6 mm, a total length of 337 mm, an outer diameter of a bearing portion of Φ4 mm, and a length of 6 mm is used, and in which the effective length of the foamed urethane is 320 mm) at a winding angle of 40° while a tension is being applied to increase the sheet total length by about 0% to 5%, to form an elastic layer arranged in a spiral shape, whereby a cleaning roll is prepared.

Preparation of Charging Roll

The same product as used in Example 1-1 is used.

Example 1-5

Preparation of Cleaning Roll

A double-sided tape with a thickness of 0.2 mm is attached to a sheet of foamed urethane (EPM-70; trade name, manufactured by INOAC Corporation) with a thickness of 2 mm and the resultant is cut into a strip with a width of 10 mm and a length of 353 mm. This strip is wound on a stepped metal shaft (as which a shaft with an outer diameter of Φ6 mm, a total length of 337 mm, an outer diameter of a bearing portion of Φ4 mm, and a length of 6 mm is used, and in which the effective length of the foamed urethane is 320 mm) at a winding angle of 25° while a tension is being applied to increase the sheet total length by about 0% to 5%, to form an elastic layer arranged in a spiral shape, whereby a cleaning roll is prepared.

Preparation of Charging Roll

The same product as used in Example 1-1 is used.

Example 1-6

Preparation of Cleaning Roll

A double-sided tape with a thickness of 0.2 mm is attached to a sheet of foamed urethane (EPM-70; trade name, manufactured by INOAC Corporation) with a thickness of 2 mm and the resultant is cut into a strip with a width of 4 mm and a length of 353 mm. This strip is wound on a stepped metal shaft (as which a shaft with an outer diameter of Φ6 mm, a total length of 337 mm, an outer diameter of a bearing portion of Φ4 mm, and a length of 6 mm is used, and in which the effective length of the foamed urethane is 320 mm) at a winding angle of 25° while a tension is being applied to increase the sheet total length by about 0% to 5%, a strip of the same foamed urethane sheet with a thickness of 2.65 mm and a width of 2 mm with double-sided tapes attached thereto is wound on both sides of the wound strip (both end portions in the width direction) while a tension is being applied to increase the sheet total length by about 0% to 5%, to form an elastic layer arranged in a spiral shape, whereby a cleaning roll is prepared.

Preparation of Charging Roll

The same product as used in Example 1-1 is used.

Example 1-7

Preparation of Cleaning Roll

A double-sided tape with a thickness of 0.2 mm is attached to a sheet of foamed urethane (EPM-70, trade name, manufactured by INOAC Corporation) with a thickness of 2 mm and the resultant is cut into a strip with a width of 4 mm and a length of 353 mm. This strip is wound on a stepped metal shaft (as which a shaft with an outer diameter of Φ6 mm, a total length of 337 mm, an outer diameter of a bearing portion of Φ4 mm, and a length of 6 mm is used, and in which the effective length of the foamed urethane is 320 mm) at a winding angle of 25° while a tension is being applied to increase the sheet total length by about 0% to 5%, a strip of the same foamed urethane sheet with a thickness of 2.75 mm and a width of 2 mm with double-sided tapes attached thereto is wound on both sides of the wound strip (both end portions in the width direction) while a tension is being applied to increase the sheet total length by about 0% to 5%, to form an elastic layer arranged in a spiral shape, whereby a cleaning roll is prepared.

Preparation of Charging Roll

The same product as used in Example 1-1 is used.

Example 1-8

Preparation of Cleaning Roll

A double-sided tape with a thickness of 0.2 mm is attached to a sheet of foamed urethane (EPM-70, trade name, manufactured by INOAC Corporation) with a thickness of 2 mm and the resultant is cut into a strip with a width of 4 mm and a length of 353 mm. This strip is wound on a stepped metal shaft (as which a shaft with an outer diameter of Φ6 mm, a total length of 337 mm, an outer diameter of a bearing portion of Φ4 mm, and a length of 6 mm is used, and in which the effective length of the foamed urethane is 320 mm) at a winding angle of 25° while a tension is being applied to increase the sheet total length by about 0% to 5%, a strip of the same foamed urethane sheet with a thickness of 3.05 mm and a width of 2 mm with double-sided tapes attached thereto is wound on both sides of the wound strip (both end portions in the width direction) while a tension is being applied to increase the sheet total length by about 0% to 5%, to form an elastic layer (material) arranged in a spiral shape, whereby a cleaning roll is prepared.

Preparation of Charging Roll

The same product as used in Example 1-1 is used.

Comparative Example 1-1

Preparation of Cleaning Roll

A hole of Φ5 mm is formed in a block of foamed urethane (EPM-70, trade name, manufactured by INOAC Corporation) by the use of a drill, a shaft (as which a shaft with an outer diameter of Φ6 mm, a total length of 337 mm, an outer diameter of a bearing portion of Φ4 mm, and a length of 6 mm is used, and in which the effective length of the foamed urethane is 320 mm) with an outer diameter of 6 mm with an adhesive applied thereto is inserted into the hole, and then the resultant is polished, whereby a foamed roll with an outer diameter of 10 mm is prepared. This roll is cut to form an elastic layer (material) arranged in a spiral shape with a spiral width of 10 mm and a spiral angle of 25°, whereby a cleaning roll is prepared.

Preparation of Charging Roll

The same product as used in Example 1-1 is used.

Comparative Example 1-2

Preparation of Cleaning Roll

A double-sided tape with a thickness of 0.2 mm is attached to a sheet of foamed urethane (EPM-70, trade name, manufactured by INOAC Corporation) with a thickness of 2 mm and the resultant is cut into a strip with a width of 6 mm and a length of 360 mm. This strip is wound on a stepped metal shaft (as which a shaft with an outer diameter of Φ6 mm, a total length of 337 mm, an outer diameter of a bearing portion of Φ4 mm, and a length of 6 mm is used, and in which the effective length of the foamed urethane is 320 mm) at a winding angle of 25° while a tension is being applied to increase the sheet total length by about 0% to 5%, a strip of the same foamed urethane sheet with a thickness of 3.3 mm and a width of 2 mm is wound on both sides (both end portions in the width direction) of the wound strip (elastic layer) while a tension is being applied to increase the sheet total length by about 0% to 5%, to form an elastic layer (material) arranged in a spiral shape, whereby a cleaning roll is prepared.

Preparation of Charging Roll

The same product as used in Example 1-1 is used.

Evaluation

The characteristics of the elastic layers (materials) of the cleaning rolls prepared in the examples are inspected and are shown as a list in Table 1.

The cleaning rolls and the charging rolls prepared in the examples are mounted on a color copier DOCUCENTRE-III C3300; trade name, manufactured by FUJI XEROX Co., Ltd.

A print test is performed on 300,000 sheets of A4. In the evaluation of the image quality, after the print test is performed on 100,000 sheets, 200,000 sheets, and 300,000 sheets, the density unevenness (cleaning capability) in a halftone image due to the cleaning unevenness of the charging roll and the existence of a color spot due to the cleaning roll pieces are determined on the basis of the following criteria. The evaluation results are shown in Table 1.

Evaluation Criteria for Cleaning Capability

A: Density unevenness in image is not generated.

B: Slight density unevenness in image is generated.

C: Density unevenness in image is generated.

Evaluation Criteria for Color Spot

A: A color spot in image is not generated.

C: A color spot in image is generated.

TABLE 1

| | Characteristics of Elastic Layer (Material) of Cleaning Roll | | | | | | | Cleaning Performance | | | |
|---|---|---|---|---|---|---|---|---|---|---|---|
| | Spiral Angle (°) | Spiral Width (mm) | Spiral Pitch (mm) | Cover-age (%) | Thicness at center portion (Ta mm) | Thicness at both end portions (Tb mm) | Tb/Ta | after 100,000 prints | after 200,000 prints | after 300,000 prints | Color Spot |
| Example 1-1 | 65 | 6.7 | 9.6 | 70 | 1.51 | 1.53 | 1.01 | A | A | B | A |
| Example 1-2 | 63 | 6.9 | 10.4 | 66 | 1.53 | 1.56 | 1.02 | A | A | A | A |
| Example 1-3 | 58 | 7.1 | 11.8 | 60 | 1.55 | 1.65 | 1.06 | A | A | A | A |
| Example 1-4 | 40 | 9.3 | 22.5 | 41 | 1.6 | 1.85 | 1.15 | A | A | A | A |
| Example 1-5 | 25 | 23.7 | 40.4 | 59 | 1.75 | 2.3 | 1.31 | A | A | A | A |
| Example 1-6 | 25 | 18.9 | 40.4 | 47 | 1.75 | 2.6 | 1.49 | A | A | A | A |
| Example 1-7 | 25 | 18.9 | 40.4 | 47 | 1.75 | 2.7 | 1.54 | A | A | B | A |
| Example 1-8 | 25 | 18.9 | 40.4 | 47 | 1.75 | 3.0 | 1.71 | A | A | B | A |
| Comparative Example 1-1 | — | — | — | — | 2.0 | 2.0 | 1.0 | A | B | C | C |
| Comparative Example 1-1 | 25 | 18.9 | 40.4 | 47 | 1.75 | 3.15 | 1.80 | A | B | C | A |

It can be seen from the results that the cleaning rolls prepared in Examples 1-1 to 1-8 are better in cleaning capability than the cleaning rolls prepared in Comparative Examples 1-1 and 1-2. In the cleaning rolls prepared in Examples 1-1 to 1-8, no color spot is generated due to the polishing pieces generated in the polished cleaning roll. In this point, the examples are also more excellent than the cleaning roll prepared in Comparative Example 1-1.

Example 2-1

Preparation of Cleaning Roll

A cleaning roll is prepared in a manner substantially the same as that in Example 1-5 except that a sheet of foamed urethane (BF-150; trade name, manufactured by INOAC Corporation) is used instead of a sheet of foamed urethane (EPM-70; trade name, manufactured by INOAC Corporation) in Example 1-5.

Preparation of Charging Roll

The same product as used in Example 1-1 is used.

Example 2-2

Preparation of Cleaning Roll

The same product (a cleaning roll prepared by using a sheet of foamed urethane (EPM-70; trade name, manufactured by INOAC Corporation)) as used in Example 1-5 is used.

Preparation of Charging Roll

The same product as used in Example 1-1 is used.

Example 2-3

Preparation of Cleaning Roll

A cleaning roll is prepared in a manner substantially the same as that in Example 1-5 except that a sheet of foamed urethane (RSM-55; trade name, manufactured by INOAC Corporation) is used instead of a sheet of foamed urethane (EPM-70; trade name, manufactured by INOAC Corporation) in Example 1-5.

Preparation of Charging Roll

The same product as used in Example 1-1 is used.

Example 2-4

Preparation of Cleaning Roll

A cleaning roll is prepared in a manner substantially the same as that in Example 1-5 except that a sheet of foamed urethane (SP80; trade name, manufactured by INOAC Corporation) is used instead of a sheet of foamed urethane (EPM-70; trade name, manufactured by INOAC Corporation) in Example 1-5.

Preparation of Charging Roll

The same product as used in Example 1-1 is used.

Comparative Example 2-1

Preparation of Cleaning Roll

A hole of Φ5 mm is formed in a block of foamed urethane (BF-150, trade name, manufactured by INOAC Corporation) by the use of a drill, a shaft with an outer diameter of 6 mm and with an adhesive applied thereto is inserted into the hole, and then the block of foamed urethane treats cutting work, whereby a foamed roll with an outer diameter of 10 mm is prepared. This roll is used as a cleaning roll.

Preparation of Charging Roll

The same product as used in Example 1-1 is used.

Comparative Example 2-2

Preparation of Cleaning Roll

A hole of Φ5 mm is formed in a block of foamed urethane (EPM-70, trade name, manufactured by INOAC Corporation) by the use of a drill, a shaft with an outer diameter of 6 mm and with an adhesive applied thereto is inserted into the hole, and then the block of foamed urethane treats cutting work, whereby a foamed roll with an outer diameter of 10 mm is prepared. This roll is used as a cleaning roll.

Preparation of Charging Roll

The same product as used in Example 1-1 is used.

Comparative Example 2-3

Preparation of Cleaning Roll

A hole of Φ5 mm is formed in a block of foamed urethane (RSM-55, trade name, manufactured by INOAC Corporation) by the use of a drill, a shaft with an outer diameter of 6 mm and with an adhesive applied thereto is inserted into the hole, and then the block of foamed urethane treats cutting work, whereby a foamed roll with an outer diameter of 10 mm is prepared. This roll is used as a cleaning roll.

Preparation of Charging Roll

The same product as used in Example 1-1 is used.

Comparative Example 2-4

Preparation of Cleaning Roll

A hole of Φ5 mm is formed in a block of foamed urethane (SP80, trade name, manufactured by INOAC Corporation) by the use of a drill, a shaft with an outer diameter of 6 mm and with an adhesive applied thereto is inserted into the hole, and then the block of foamed urethane treats cutting work, whereby a foamed roll with an outer diameter of 10 mm is prepared. This roll is used as a cleaning roll.

Preparation of Charging Roll

The same product as used in Example 1-1 is used.

Evaluation

The compositions of the elastic layers (materials) of the cleaning rolls prepared in the examples are shown as a list in Table 2.

The cleaning rolls and the charging rolls prepared in the examples are evaluated as follows. The results are shown in Table 2.

Image Defect after Storage

The cleaning rolls and the charging rolls prepared in the examples are mounted on a process cartridge for a color copier DOCUCENTRE-III C3300 manufactured by FUJI XEROX Co., Ltd. After this process cartridge is left under the environment of 30° C. and 75% for 10 days, the density unevenness in halftone image quality is evaluated on the basis of the following criteria.

Evaluation Criteria for Image Defect

A: Density unevenness in image is not generated.

B: Density unevenness in image is generated but is acceptable.

C: Density unevenness in image is generated and is not acceptable.

Cleaning Capability and Color Spot

The cleaning rolls and the charging rolls prepared in the examples are mounted on a color copier DOCUCENTRE-III C3300; trade name, manufactured by FUJI XEROX Co., Ltd.

A print test is performed on 300,000 sheets of A4. In the evaluation of the image quality, after the print test is performed on 300,000 sheets, the density unevenness (cleaning capability) in a halftone image due to the cleaning unevenness of the charging roll and the existence of a color spot due to the cleaning roll pieces are determined on the basis of the following criteria.

Evaluation Criteria for Cleaning Capability

A: Density unevenness in image is not generated.

B: Slight density unevenness in image is generated.

C: Density unevenness in image is generated.

Evaluation Criteria for Color Spot

A: A color spot in terms of image is not generated.

C: A color spot in terms of image is generated.

Evaluation due to Humidity and Heat

After the cleaning rolls prepared in the examples are left under an environment of 70° C. and 95% for 1 month, the cleaning rolls are mounted on a process cartridge, and a halftone image is printed out, and then the degree of deterioration is determined on the basis of the following criteria.

Evaluation Criteria for Deterioration due to Humidity and Heat

A: Density unevenness in image is not generated.

B: Slight density unevenness in image is generated.

C: Density unevenness in image is generated.

TABLE 2

| | Composition of Elastic Layer (Material) of Cleaning Roll | | | | Image defect | Deterioration | | |
|---|---|---|---|---|---|---|---|---|
| | Material | Foam Stabilizer | Kind of Polyurethane | Shape | after Storage | due to Humidity and Heat | Cleaning Performance | Color Spot |
| Example 2-1 | BF150 | Other than Silicone Oil | Ether-based | Spiral | A | A | B | A |
| Example 2-2 | EPM70 | Silicone Oil | Ether-based | Spiral | B | A | A | A |
| Example 2-3 | RSM55 | Other than Silicone Oil | Ester-based | Spiral | A | B | A | A |
| Example 2-4 | SP80 | Silicone Oil | Ether-based | Spiral | B | B | A | A |
| Comparative Example 2-1 | BF150 | Other than Silicone Oil | Ether-based | Cylinder | A | A | C | C |
| Comparative Example 2-2 | EPM70 | Silicone Oil | Ether-based | Cylinder | C | A | B | C |
| Comparative Example 2-3 | RSM55 | Other than Silicone Oil | Ester-based | Cylinder | A | C | B | C |
| Comparative Example 2-4 | SP80 | Silicone Oil | Ether-based | Cylinder | C | C | B | C |

It can be seen from the results that the cleaning rolls prepared in Examples 2-1 to 2-4 are more excellent in cleaning capability than the cleaning rolls prepared in Comparative Examples 2-1 to 2-4.

In the cleaning rolls prepared in Examples 2-1 to 2-4, no color spot is generated due to the polishing pieces generated in the polished cleaning roll. In this point, the examples are also more excellent than the cleaning rolls prepared in Comparative Examples 2-1 to 2-4.

The cleaning roll prepared in Example 2-1 is more excellent in image defect after storage and deterioration due to humidity and heat than the cleaning rolls prepared in Examples 2-2 to 2-4.

Example 3

Example 3-1

Preparation of Cleaning Roll

A double-sided tape with a thickness of 0.2 mm is attached to a sheet of foamed urethane (EPM-70, trade name, manufactured by INOAC Corporation) with a thickness of 2 mm and the resultant is cut into a strip of the shape shown in FIG. 7 with a width of 6 mm and a length of 757 mm. The strip has a shape with $\theta c=45°$, $\theta e1=\theta e2=26°$, Rc=6 mm, and Re1–Re2=6 mm (see FIG. 7). The length of the center portion of the strip is 290 mm and the length of the first end portion and the second end portion is respectively 53 mm.

This strip is wound on a stepped metal shaft (as which a shaft with an outer diameter of Φ6 mm, a total length of 337 mm, an outer diameter of a bearing portion of Φ4 mm, and a length of 6 mm is used, and in which the effective length of the foamed urethane is 320 mm) while a tension is being applied to increase the sheet total length by about 0 to 5%, to form an elastic layer arranged in a spiral shape, whereby a cleaning roll is prepared.

Preparation of Charging Roll

The same product as used in Example 1-1 is used.

Example 3-2

Preparation of Cleaning Roll

A double-sided tape with a thickness of 0.2 mm is attached to a sheet of foamed urethane (BF-150, trade name, manufactured by INOAC Corporation) with a thickness of 2 mm and the resultant is cut into a strip (linear strip) with a width of 6 mm and a length of 757 mm. This strip is wound on a stepped metal shaft (as which a shaft with an outer diameter of mm, a total length of 337 mm, an outer diameter of a bearing portion of Φ4 mm, and a length of 6 mm is used, and in which the effective length of the foamed urethane is 320 mm) at a winding angle of 26° in both end portions of the axial direction of the shaft and at a winding angle of 45° in the center portion while a tension is being applied to increase the sheet total length by about 0% to 5%, to form an elastic layer arranged in a spiral shape, whereby a cleaning roll is prepared.

Preparation of Charging Roll

The same product as used in Example 1-1 is used.

Evaluation

The characteristics of the elastic layers of the cleaning rolls prepared in the examples are inspected and are shown as a list in Table 3.

The cleaning rolls and the charging rolls prepared in the examples are mounted on a color copier DOCUCENTRE-III C3300; trade name, manufactured by FUJI XEROX Co., Ltd.

A print test is performed on 300,000 sheets of A4. In the evaluation of the image quality, after the print test is performed on 100,000 sheets, 200,000 sheets, and 300,000 sheets, the density unevenness (cleaning capability) in a halftone image due to the cleaning unevenness of the charging roll and the existence of a color spot due to the cleaning roll pieces are determined on the basis of the following criteria. The evaluation results are shown in Table 4.

Determination Criteria for Cleaning Capability

A: Density unevenness in image is not generated.

B: Slight density unevenness in image is generated.

C: Density unevenness in image is generated.

Determination Criteria for Color Spot

A: A color spot in terms of image is not generated.

C: A color spot in terms of image y is generated.

Under an environment of a temperature of 10° C. and a humidity of 15% RH, the discharge current of the charging roll is adjusted and the minimum current with which a white spot is not generated is measured. The result is shown in Table 4.

Tables 3 and 4 show the evaluation results using the cleaning roll prepared in Example 1-1.

TABLE 3

| | Characteristics of Elastic Layer (Material) of Cleaning Roll | | | | | | | | | | | | | |
|---|---|---|---|---|---|---|---|---|---|---|---|---|---|---|
| | at center portion in shaft axial direction | | | | | | | at both end portions in shaft axial direction | | | | | | |
| | Spiral Angle (°) | Spiral Width (mm) | Spiral Pitch (mm) | Cover-age (%) | Thicness at center part in Width (Ta mm) | Thicness at both edge parts in Width (Tb mm) | Tb/Ta | Spiral Angle (°) | Spiral Width (mm) | Spiral Pitch (mm) | Cover-age (%) | Thicness at center part in Width (Ta mm) | Thicness at both edge parts in Width (Tb mm) | Tb/Ta |
| Example 1-1 | 65 | 6.7 | 9.6 | 70 | 1.51 | 1.53 | 1.01 | 65 | 6.7 | 9.6 | 70 | 1.51 | 1.53 | 1.01 |
| Example 3-1 | 45 | 6 | 20 | 45 | 1.8 | 2.1 | 1.16 | 26 | 6 | 38 | 35 | 1.9 | 2.2 | 1.15 |
| Example 3-2 | 45 | 6 | 20 | 45 | 1.8 | 2.1 | 1.16 | 26 | 6 | 38 | 35 | 2.0 | 2.3 | 1.15 |

Both end portions of the elastic layer in the axial direction of the shaft mean areas from the end surfaces in the shaft axial direction where the elastic layer exists to 50 mm inside, and the center portion of the elastic layer in the axial direction of the shaft means an area interposed therebetween.

TABLE 4

| | Cleaning Performance | | | | |
|---|---|---|---|---|---|
| | after 100,000 prints | after 200,000 prints | after 300,000 prints | Color Spot | Minimum Current (mA) |
| Example1-1 | A | A | B | A | 2.40 |
| Example3-1 | A | A | A | A | 2.25 |
| Example3-2 | A | A | A | A | 2.28 |

It can be seen from the results that the minimum current value in Examples 3-1 and 3-2 is lower than that in Example 1-1. Accordingly, it can be seen that the unevenness in contact pressure (nip pressure) of the charging roll against the photoreceptor in the axial direction is suppressed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaning member for an image forming apparatus, comprising:

a shaft body; and an elastic material that is wound on the outer peripheral surface of the shaft body in a spiral shape, the elastic material satisfying the following Expressions (A1) and (A2):

$$1<Tb/Ta<1.75 \quad \text{Expression (A1)}$$

$$0.5<Ta<4.0, \quad \text{Expression (A2)}$$

in Expressions (A1) and (A2), Ta representing a thickness of a center portion in a spiral width direction of the elastic material in millimeters, and Tb representing a thickness of both end portions in the spiral width direction of the elastic material in millimeters.

2. The cleaning member according to claim 1, wherein the elastic material satisfies the following Expressions (B1) and (B2):

$$1.02<Tb/Ta<1.5 \quad \text{Expression (B1)}$$

$$1.0<Ta<3.0, \text{ and} \quad \text{Expression (B2)}$$

in Expressions (B1) and (B2), Ta and Tb each independently represent the same definitions as those in Expressions (A1) and (A2).

3. The cleaning member according to claim 1, wherein a spiral angle θ of the elastic material is in a range of from about 10° to about 65° and a spiral width of the elastic material is in a range of from about 3 mm to about 25 mm.

4. The cleaning member according to claim 1, wherein a spiral pitch of the center portion of the elastic material in an axial direction of the shaft body is less than a spiral pitch of both ends in the axial direction of the shaft body.

5. The cleaning member according to claim 4, wherein the elastic material is a strip-shaped member that is wound on the outer peripheral surface of the shaft body from one end to another end in the axial direction of the shaft body, the strip-shaped elastic material comprising:

a linear center portion;

a first end portion bent or curved toward one side in a width direction from one end in a longitudinal direction of the center portion; and a second end portion bent or curved toward the opposite side in the width direction from the opposite end in the longitudinal direction of the center portion.

6. The cleaning member according to claim 4, wherein the spiral pitch of the center portion is in a range of from about 3 mm to about 25 mm.

7. The cleaning member according to claim 4, wherein a coverage of the elastic material is in a range of from about 20% to about 70%; a coverage of the elastic material being defined by a relationship of 100R1/(R1+R2), wherein R1 represents a spiral width of the elastic material, and R2 represents a spiral pitch of the elastic material.

8. The cleaning member according to claim 1, wherein the elastic material comprises polyether urethane foamed by using a foam stabilizer other than silicon oil.

9. A charging device comprising:

a charging member that charges a member to be charged; and a cleaning member for an image forming apparatus according to claim 1, which is disposed so as to contact a surface of the charging member and clean the surface of the charging member.

10. The charging device according to claim 9, wherein the member is a photoreceptor.

11. A process cartridge comprising the charging device according to claim 9 and being detachably attached to an image forming apparatus.

12. An image forming apparatus comprising:

an image carrier;

a charging unit that charges a surface of the image carrier and that includes the charging device according to claim 9;

a latent image forming unit that forms a latent image on the charged surface of the image carrier;

a developing unit that develops the latent image formed on the image carrier into a toner image by use of a toner; and a transfer unit that transfers the toner image onto a transfer medium.

13. A unit for an image forming apparatus comprising:

a member to be cleaned; and the cleaning member for an image forming apparatus according to claim 1, which is disposed so as to contact a surface of the member to be cleaned and clean the surface of the member to be cleaned.

14. A process cartridge comprising at least the unit for an image forming apparatus according to claim 13 and being detachably attached to an image forming apparatus.

15. An image forming apparatus comprising the unit for an image forming apparatus according to claim 13.

* * * * *